US012727732B2

(12) United States Patent
Wu et al.

(10) Patent No.: US 12,727,732 B2
(45) Date of Patent: Sep. 8, 2026

(54) CLEANING ROBOT SYSTEM

(71) Applicant: Positec Power Tools (Suzhou) Co., Ltd., Suzhou (CN)

(72) Inventors: Hongbing Wu, Suzhou (CN); Shisong Zhang, Suzhou (CN); Hongfeng Zhong, Suzhou (CN)

(73) Assignee: Positec Power Tools (Suzhou) Co., Ltd, Jiangsu (CN)

( * ) Notice: Subject to any disclaimer, the term of this patent is extended or adjusted under 35 U.S.C. 154(b) by 703 days.

(21) Appl. No.: 18/033,939

(22) PCT Filed: Oct. 26, 2021

(86) PCT No.: PCT/CN2021/126450
§ 371 (c)(1),
(2) Date: Apr. 26, 2023

(87) PCT Pub. No.: WO2022/089434
PCT Pub. Date: May 5, 2022

(65) Prior Publication Data

US 2023/0389768 A1 Dec. 7, 2023

(30) Foreign Application Priority Data

Oct. 26, 2020 (CN) ..... 202011156723.2
Oct. 26, 2020 (CN) ..... 202022406958.4

(51) Int. Cl.
*A47L 11/40* (2006.01)
*A47L 11/28* (2006.01)

(52) U.S. Cl.
CPC ..... *A47L 11/4091* (2013.01); *A47L 11/28* (2013.01); *A47L 11/4036* (2013.01); *A47L 11/4066* (2013.01); *A47L 2201/028* (2013.01)

(58) Field of Classification Search
CPC ..... A47L 2201/028; A47L 11/4066; A47L 11/4036; A47L 11/28; A47L 11/4091
(Continued)

(56) References Cited

U.S. PATENT DOCUMENTS

2020/0000302 A1* 1/2020 Morin ..... A47L 11/4005
2020/0353822 A1 11/2020 Romanov et al.
2022/0142444 A1* 5/2022 Xie ..... A47L 11/4055

FOREIGN PATENT DOCUMENTS

CN 104545710 A 4/2015
CN 205697568 U 11/2016
(Continued)

OTHER PUBLICATIONS

Second Office Action in CN application No. CN202180009758.X, dated Jan. 5, 2024, 13 pages.
(Continued)

*Primary Examiner* — Katina N. Henson
(74) *Attorney, Agent, or Firm* — Lee & Hayes, P.C.

(57) ABSTRACT

A cleaning robot system, including a cleaning robot with a cleaning module connected to the cleaning robot. The cleaning module includes a main body, connectable with a cleaning medium to wipe a working surface. The main body is provided with a connection region for connection of the cleaning medium and a demounting region for demounting of the cleaning medium, and no interconnection action occurs between the demounting region and the cleaning medium. The cleaning module of the cleaning robot effectively fixes the cleaning medium to the main body through the connection region. When the cleaning medium needs to be removed from the main body, the cleaning medium can be more easily and conveniently be demounted from the main body by means of the demounting region because no
(Continued)

interconnection action occurs between the demounting region and the cleaning medium.

17 Claims, 22 Drawing Sheets

(58) Field of Classification Search
USPC ..... 15/98
See application file for complete search history.

(56) References Cited

FOREIGN PATENT DOCUMENTS

| | | | | | |
|---|---|---|---|---|---|
| CN | 107212817 | A | | 9/2017 | |
| CN | 107518835 | A | | 12/2017 | |
| CN | 107951448 | A | * | 4/2018 | ..... A47L 11/4091 |
| CN | 109222774 | A | | 1/2019 | |
| CN | 109875465 | A | | 6/2019 | |
| CN | 110495822 | A | | 11/2019 | |
| CN | 111345743 | A | | 6/2020 | |
| CN | 211674049 | U | | 10/2020 | |
| CN | 211723013 | U | | 10/2020 | |
| CN | 211723014 | U | | 10/2020 | |
| CN | 110123216 | B | | 11/2020 | |
| CN | 218588941 | U | | 3/2023 | |
| JP | 2005040578 | A | | 2/2005 | |
| JP | 2013244225 | A | | 12/2013 | |
| WO | WO2018137405 | A1 | | 8/2018 | |
| WO | WO2020125774 | A1 | | 6/2020 | |

OTHER PUBLICATIONS

First Office Action in CN application No. CN202180009758.X, dated Apr. 1, 2023, 8 pages.
First search in CN application No. CN202180009758.X , dated Apr. 1, 2023, 2 pages.
Supplementary European search report in application No. EP21885161.6, dated Aug. 26, 2024, 3 pages.
European search opinion in application No. EP21885161.6 , dated Aug. 26, 2024, 6 pages.
International Search Report in application No. PCT/CN2021/126450, dated Jan. 27, 2022, 2 pages.
Written Opinion in application No. PCT/CN2021/126450, dated Jan. 27, 2022, 6 pages.

* cited by examiner

CLEANING ROBOT SYSTEM

CROSS-REFERENCE TO RELATED APPLICATION

This application is a National Stage Application of International Application No. PCT/CN2021/126450, filed on Oct. 26, 2021, which claims benefit of and priority to Chinese Patent Application No. 202011156723.2, filed on Oct. 26, 2020, and Chinese Patent Application No. 202022406958.4, filed on Oct. 26, 2020, all of which are hereby incorporated by reference in their entirety for all purposes as if fully set forth herein.

TECHNICAL FIELD

The disclosure relates to the technical field of cleaning equipment and accessories for cleaning equipment, and in particular to a cleaning module which can have a cleaning medium mounted thereon and can be assembled on a cleaning robot to execute a cleaning task, a device for mounting a clean or new cleaning medium to the cleaning module, a base station which includes the cleaning medium mounting device and accommodates the cleaning robot to automatically replace the cleaning medium for the cleaning robot, and a cleaning robot system including the cleaning robot and the base station.

BACKGROUND

Related Art

Cleaning robots (including but not limited to sweeping robots, mopping robots, window cleaners, etc.) generally use cleaning media (e.g., paper towels, mops, etc.) for cleaning operations. With the extension of cleaning time, stains attached to a cleaning medium increase, and the cleaning effect becomes worse. Therefore, the dirty cleaning medium has to be demounted and replaced with a clean cleaning medium.

Presently, cleaning robots on the market generally use tapes/hook-and-loop tapes (VELCRO®) to stick the cleaning medium to a cleaning tool (e.g., a mop board) or a machine body. When it is necessary to replace the cleaning medium, the cleaning medium needs to be manually torn off and replaced with a new one. This mode requires human intervention for manual replacement of the cleaning medium, and a user easily gets his/her hands dirty in a collection process, thereby having a bad experience. By contrast, when the cleaning medium is automatically replaced by the base station, the cleaning tool or the machine body has strong adhesion to the cleaning medium, and it is difficult to separate the cleaning medium from the cleaning tool or the machine body.

SUMMARY

In view of this, embodiments of the disclosure provide a cleaning module which can have a cleaning medium mounted thereon and can be assembled on a cleaning robot to execute a cleaning task, a device for mounting a clean or new cleaning medium for the cleaning module, and a base station which includes the cleaning medium mounting device and accommodates the cleaning robot to automatically replace the cleaning medium for the cleaning robot, so as to solve the above problems.

In order to achieve the above objectives, the disclosure provides the following technical solutions.

Provided is a cleaning robot system, including a cleaning robot. The cleaning robot includes: a framework, a moving module and a cleaning module. The moving module is arranged at a bottom of the framework to drive the cleaning robot to travel on a working surface. The cleaning module is configured to clean the working surface. The cleaning module is connected to the cleaning robot. The cleaning module includes: a main body. The main body is connectable with a cleaning medium to wipe the working surface. The main body is provided with a connection region for connection of the cleaning medium and a demounting region for demounting of the cleaning medium, and no interconnection action occurs between the demounting region and the cleaning medium.

In the above cleaning robot system, the cleaning module of the cleaning robot effectively fixes the cleaning medium to the main body through the connection region. When the cleaning medium needs to be removed from the main body, the cleaning medium can be more easily and conveniently demounted from the main body by means of the demounting region because no interconnection action occurs between the demounting region and the cleaning medium.

Preferably, the connection region includes an adhesion surface. The cleaning medium adheres to the adhesion surface.

Preferably, the demounting region includes notches. An outer edge of the main body is recessed into the main body to form the notches.

Preferably, the main body has an integral body. The cleaning medium is connected to the integral body. The connection region and the demounting region are arranged on the integral body.

Preferably, when the cleaning robot works, the adhesion surface is opposite to the working surface.

Preferably, the connection region and/or the demounting region are/is arranged in at least a pair of two opposite ends of the main body.

Preferably, the main body at least includes a pair of opposite long ends. The connection region and/or the demounting region are/is at least partially arranged on the opposite long ends. Preferably, two ends of the opposite long ends respectively include two head portions, and the head portions are provided with the connection region.

Preferably, the connection region is spaced apart from the demounting region.

Preferably, the connection region is adjacent to the demounting region. A distance between adjacent outer edges of the connection region and the demounting region is in a preset range.

Preferably, the connection region and the demounting region are arranged at two opposite ends of the main body.

Preferably, the number of the demounting regions is two or more.

Preferably, the connection region arranged at one end of the main body is a whole. Projections of the two or more demounting regions to a lateral direction of the main body form first projections. A projection of the connection region to the lateral direction of the main body forms a second projection. The first projections and the second projection at least partially overlap.

Preferably, the number of the connection regions is two or more, and the connection regions are mutually non-contiguous.

Preferably, a plurality of connection regions are formed between adjacent ends of the main body, and at least two or more of the connection regions are provided with the connection region.

Preferably, the main body includes a body and turnover pieces. The turnover pieces are connected to the body and rotating relative to the body, and the connection region and the demounting region are arranged on the turnover pieces.

Preferably, the connection region has an adhesion face, the main body has a working face, and the cleaning medium is connected to the adhesion face and the working face. The turnover piece has a first state and a second state. When the turnover piece is in the first state, a first angle is formed between the adhesion face and the working face. When the turnover piece is in the second working state, a second angle is formed between the adhesion face and the working face. The first angle is different from the second angle.

Preferably, the first state is an open state, and the second state is a closed state. When the turnover piece is in the open state, the adhesion face and the working face point to a same side of the main body. When the turnover piece is in the closed state, the adhesion face and the working face point to two sides substantially opposite to each other.

Preferably, the turnover pieces are arranged at two opposite ends of the main body.

Preferably, when being switched from the open state to the closed state, the turnover piece turns towards an inner side of the main body, and the adhesion face drives the cleaning medium to turn inwards to tension the cleaning medium.

Preferably, the cleaning robot system further includes a closure maintainer, configured to apply a closure maintenance force to the turnover piece so as to maintain the turnover piece in the closed state or move it towards the closed state.

Preferably, the closure maintainer includes a first attachment element arranged on the main body, and a second attachment element arranged on the turnover piece and corresponding to the first attachment element. One of the first attachment element and the second attachment element is a magnetic element, and the other is a magnetizable element or a magnetic element. The closure maintenance force is a magnetic attraction force produced between the first attachment element and the second attachment element.

Preferably, the cleaning module further includes an opening executer, configured to apply an opening execution force to the turnover piece so as to maintain the turnover piece in the open state or move it towards the open state.

Preferably, the opening executer includes a lever rotatably arranged on the main body. The lever has a stressed end and an acting end, and a rotatable connection point for the lever and the main body is located between the stressed end and the acting end. The stressed end receives an external force to drive the lever to rotate, and the acting end corresponds to the turnover piece. The opening execution force includes a mechanical pushing force applied by the acting end to the turnover piece.

Preferably, the opening executer further includes a torsion spring arranged between the main body and the turnover piece. The opening execution force further includes a torsional force applied by the torsion spring to the turnover piece to turn the turnover piece towards the open state.

Preferably, the turnover piece is made of a flexible and elastic material. The turnover piece is maintained in the closed state by means of its own elasticity. When the cleaning medium receives an external force directed away from the main body, the cleaning medium pulls the turnover piece to turn outwards through the adhesion face.

Preferably, the demounting region is adjacent to the connection region. A distance between adjacent outer edges of the connection region and the demounting region is in a preset range.

Provided is a cleaning robot system, including a cleaning robot. The cleaning robot is connected with a cleaning module. The cleaning module includes a main body and a turnover piece. The main body has a working face connectable with a cleaning medium. The turnover piece has an adhesion face adherable to the cleaning medium. The turnover piece is rotatably arranged on the main body and has a first state and a second state. When the turnover piece is in the first state, a first angle is formed between the adhesion face and the working face. When the turnover piece is in the second working state, a second angle is formed between the adhesion face and the working face. The first angle is different from the second angle.

Provided is a cleaning robot system, including a cleaning robot. The cleaning robot includes a framework, a moving module, and a cleaning module. The moving module is arranged at a bottom of the framework to drive the cleaning robot to travel on a working surface. The cleaning module is configured to clean the working surface. The cleaning module is connected to the cleaning robot. The cleaning module includes a main body and a base station. The main body is connectable with a cleaning medium to wipe the working surface. The main body is provided with a connection region for connection of the cleaning medium and a demounting region for demounting of the cleaning medium, and no interconnection action occurs between the demounting region and the cleaning medium. The base station includes a housing and a cleaning medium collection device. The cleaning medium collection device is arranged on the housing and configured to demount and collect the cleaning medium mounted on the cleaning module.

The above base station can automatically replace the cleaning medium without user intervention, including demounting and collection of a dirty cleaning medium on the cleaning module and mounting of a new cleaning medium. This allows for a higher quality user experience to be achieved.

Preferably, the cleaning medium collection device includes a separation module. The separation module acts on the cleaning medium covering the demounting region to separate the cleaning medium from the main body.

Preferably, the cleaning medium collection device further includes a collection box, configured to collect the cleaning medium separated by the separation module.

Preferably, the collection box is arranged on a moving path of the separated cleaning medium, thereby making the cleaning medium enter the collection box.

Preferably, the separation module applies an external force directed away from the main body to the cleaning medium covering the demounting region to demount the cleaning medium, and the separated cleaning medium falls into the collection box by its own gravity.

Preferably, the separation module applies an external force directed away from the main body to the cleaning medium covering the demounting region to demount the cleaning medium, and the cleaning medium is brought into the collection box by the external force.

Preferably, the separation module includes paper detaching hooks. The paper detaching hooks correspond to the demounting region, hook the cleaning medium covering the demounting region and apply an external force directed away from the main body to the cleaning medium to separate the cleaning medium from the main body.

Preferably, the paper detaching hooks are at least partially located in the collection box.

Preferably, one side of the collection box is provided with an opening, and the paper detaching hooks are distributed at two sides of the opening.

Preferably, one side of the collection box is provided with an opening, and the paper detaching hooks are arranged outside the opening relative to the collection box.

Preferably, an upper side of the collection box is provided with an opening, and the paper detaching hooks are arranged above the opening relative to the collection box.

Preferably, the cleaning module moves beyond the paper detaching hooks; the cleaning module moves reversely, so that the cleaning medium covering the demounting region is hooked by the paper detaching hooks; the cleaning module continues to move; and the cleaning medium is demounted.

Preferably, the collection box is provided with cover bodies, and the paper detaching hooks have an outstretched state of extending into the housing and a hidden state of being received in the cover bodies.

Preferably, rotating shafts are rotatably arranged on the collection box, and the paper detaching hooks are arranged on the rotating shafts. The rotating shafts drive the paper detaching hooks to be switched between the received state and the outstretched state.

The above description is only an overview of the technical solutions (embodiments) of the disclosure. In order to better understand the technical means of the disclosure and implement it in accordance with the contents of the specification, the following specific implementations of the disclosure in conjunction with the accompanying drawings will be described in details below.

Figure 1:
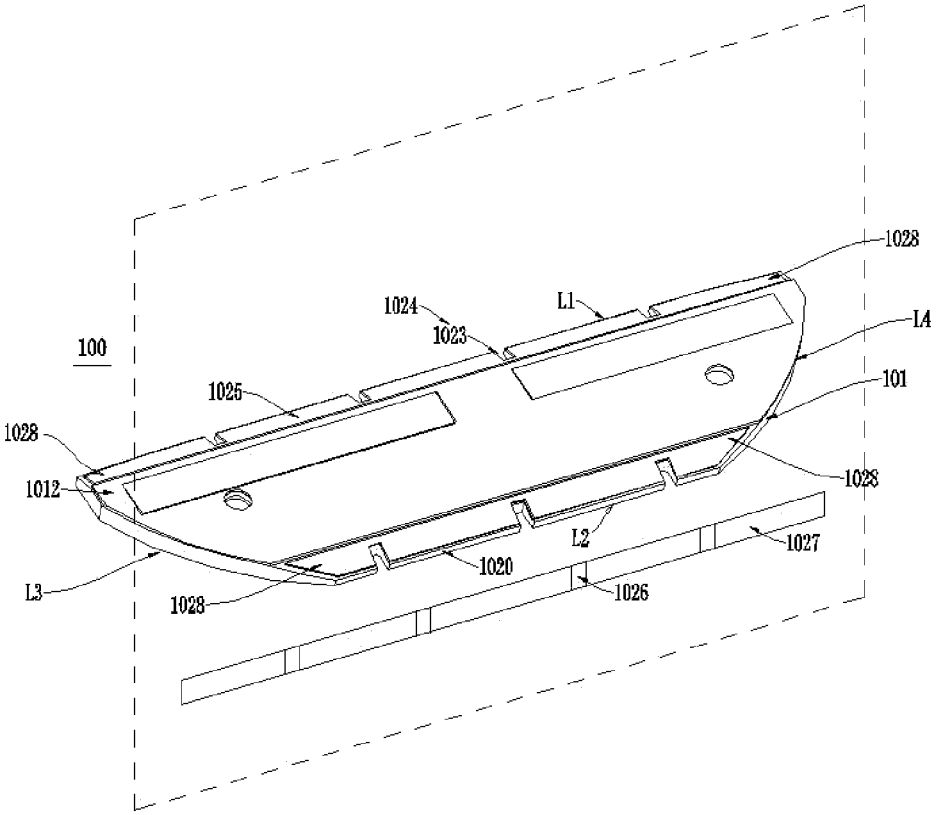
FIG. 1 is a schematic three-dimensional view of a cleaning module of a first embodiment of the disclosure.

The following is a listing and description of reference signs used in this disclosure:

100, cleaning module; 101, main body; 1011, first face; 1012, working face; 102, turnover piece; 1020, connection region; 1021, adhesion face; 1022, second face; 1023, notch; 1024, demounting region; 1025, adhesion surface; 1026, first projection; 1027, second projection; 1028, head portion; 103, rotating shaft; 104, torsion spring; 105, lever; 106, groove;

200, cleaning medium collection device; 201, collection box; 2011, lower housing; 2012, upper housing; 202, paper detaching hook; 203, rotating shaft; 204, upper cover body; 205, lower cover body;

300, cleaning medium mounting device; 301, chassis; 302, floating plate; 303, supply module; 304, gripping jaw; 3041, pivoting section; 3042, pressing section; 305, elastic piece; 306, stop portion; 307, protrusion; 308, rod body; 309, pushing mechanism; 3091, first pushing wheel; 3092, second pushing wheel; 310, driving assembly; 3101, cam; 3102, pendulum bar;

400, support device;

500, base station; 501, lifting mechanism; 502, housing; 503, base plate tray; 504, moving mechanism; 5041, horizontal traction section; 505, adsorption plate; 506, first chute; 507, second chute; 508, third chute; 509, first roller wheel; 510, first connector; 511, second connector; 512, second roller wheel;

600, cleaning robot;

F1, normal direction of adhesion face; F2, normal direction of working face; L1, L2, long end; L3, L4, short end.

DETAILED DESCRIPTION

Embodiments of the disclosure provide a cleaning module which can have a cleaning medium mounted thereon and can be assembled on a cleaning robot to execute a cleaning task, a device for mounting a clean or new cleaning medium for the cleaning module, a base station which includes the cleaning medium mounting device and accommodates the cleaning robot to automatically replace the cleaning medium for the cleaning robot, and a cleaning robot system including the cleaning robot and the base station.

A cleaning robot may have any suitable existing structure and may belong to any suitable existing category, such as a sweeping robot, a mopping robot, a window cleaning robot, etc. In an embodiment, the cleaning robot includes a framework, a moving module ("mover") arranged at a bottom of the framework and configured to drive the cleaning robot to travel on a working surface, an energy supply unit (e.g., battery pack) arranged on the framework, and a control module arranged on the framework and electrically connected with the energy supply unit. A cleaning module ("cleaner") is arranged at the bottom of the framework, and a cleaning medium mounted thereon is in contact with the working surface, thereby executing a cleaning task. In a further embodiment, the framework is provided with a water tank configured to contain a liquid to wet the cleaning medium mounted on the cleaning module, so as to realize wet mopping.

In an optional embodiment, the moving module includes driving wheels at the back side of the bottom of the framework and a caster arranged at the front end of the bottom of the framework. The driving wheels act as power wheels, and rotate under the drive of a motor connected with the control module. The caster may be connected with the control module, and can be retracted or let down under the control of the control module. A lifting mechanism for driving the cleaning module to rise or fall may be arranged in the framework. The lifting mechanism can adopt a known cam structure.

A top of the framework may be provided with a detection element connected with the control module, such as a laser scanning module, for detecting whether there are obstacles ahead in the traveling direction of the cleaning robot. When detecting that there are obstacles ahead in the traveling direction of the cleaning robot, the control module controls the lifting mechanism to lift the cleaning module and let down the caster. At this point, the cleaning robot is in an obstacle surmounting mode. After the cleaning robot avoids the obstacles, the control module controls the lifting mechanism to let down the cleaning module and retract the caster. At this point, the cleaning robot is in a working mode, that is, it may perform a cleaning operation.

In order to achieve fundamental functions of the cleaning robot, the cleaning robot in the embodiments of the disclosure may further include other necessary modules or components, such as a rolling brush, side brushes, a suction port, a dust box, a battery, a motor, etc. It should be noted that the other necessary modules or components included in the cleaning robot may have any suitable existing structure. In order to clearly and briefly explain the technical solutions provided by the disclosure, unnecessary details of the above parts will not be given here, and the drawings in the specification have been simplified accordingly. However, it should be understood that the scope of the disclosure is not limited thereby.

As described above, the cleaning robot of the embodiments of the disclosure may be applied to cleaning operation scenarios including but not limited to sweeping, mopping, window cleaning, etc. In a specific scenario, the cleaning robot of the embodiments of the disclosure may be a mopping robot, and the mopping robot can drive the cleaning module to come into contact with the working surface such as a floor, so as to realize floor wiping.

It should be noted that the above mopping scenario is only one cleaning operation scenario for the cleaning robot of the embodiments of the disclosure. Within the conceivable scope, those skilled in the art may extend the cleaning robot of the embodiments of the disclosure to any suitable cleaning scenario. The embodiments of the disclosure are not limited to this.

This disclosure uses the mopping robot as a main embodiment. However, based on the above description, it can be seen that the protection scope of the embodiments of the disclosure is not limited thereto.

In an optional embodiment, a cleaning robot system includes a cleaning robot 600. The cleaning robot 600 is connected with a cleaning module 100. The cleaning module 100 of the embodiment of the disclosure is shown in FIG. 1 to FIG. 10. The cleaning module includes a main body 101, connectable with a cleaning medium to wipe a working surface. The main body 101 is provided with a connection region 1020 for connection of the cleaning medium and a demounting region 1024 for demounting of the cleaning medium, and no interconnection action occurs between the demounting region 1024 and the cleaning medium. In an embodiment, the cleaning module 100 is detachably connected to the cleaning robot, and the cleaning medium is connected to a surface of the main body 101 to execute a wiping operation. In other embodiments, the cleaning module 100 may also be undetachably connected to the cleaning robot.

The cleaning module 100 of the cleaning robot 600 in this embodiment effectively fixes the cleaning medium to the main body 101 through the connection region 1020. When the cleaning medium needs to be removed from the main body 101, the cleaning medium can be more easily and conveniently demounted from the main body 101 by means of the demounting region 1024 because no interconnection action occurs between the demounting region 1024 and the cleaning medium.

In an optional affixes, the connection region 1020 includes an adhesion surface 1025, and the cleaning medium adheres to the adhesion surface 1025. The cleaning medium directly adheres to the adhesion surface 1025, thereby realizing convenient mounting and simultaneously further simplifying the structure of the main body. The cleaning medium directly adheres to the adhesion surface 1025 in a way that, for example, the cleaning medium may directly adhere to the adhesion surface 1025 through hook-and-loop tapes. Of course, the cleaning medium may also be connected to the connection region 1020 in other ways, for example, indirectly connected to the connection region 1020 through magnetic pieces, VELCRO® tapes, etc.

In an optional embodiment, the demounting region 1024 includes notches 1023, and an outer edge of the main body is recessed into the main body 101 to form the notches 1023. The notches 1023 facilitates adaptation of a cleaning medium demounting structure such as paper detaching hooks 202 and thus demounting of the cleaning medium from the main body 101.

The cleaning module 100 of a first embodiment of the disclosure is shown in FIG. 1 to FIG. 4. The main body 101 has a body. The cleaning medium is connected to the body, and the connection region 1020 and the demounting region 1024 are arranged on the body. Without the aid of additional components, both the connection region 1020 and the demounting region 1024 are arranged on the body, so that the main body further simplifies the structure on the premise of realizing convenient connection and demounting of the cleaning medium. Further, when the cleaning robot works, the adhesion surface 1025 is opposite to the working surface. With this arrangement, when a new cleaning medium is mounted for the body, a new cleaning medium mounting structure directly applies to one of the cleaning medium or the body an external force directed to the other, thereby realizing a function of mounting the new cleaning medium. As such, the new cleaning medium mounting structure may be further simplified. When a dirty cleaning medium is demounted from the body, a cleaning medium demounting structure applies to one of the cleaning medium or the body an external force directed away from the other, thereby realizing a function of demounting the dirty cleaning medium. As such, the dirty cleaning medium demounting structure may also be further simplified. The adhesion surface 1025 is parallel to the working surface, or an included angle is formed between the adhesion surface 1025 and the working surface. Specifically, with reference to FIG. 4, the included angle $\alpha$ formed between the adhesion surface 1025 and the working surface is an acute angle. When the cleaning robot performs a mopping operation, the cleaning medium covering the adhesion surface 1025 is not in direct contact with the working surface. This arrangement may simplify the structure for mounting and demounting the cleaning medium, and may also avoid a direct friction between the adhesion surface 1025 and the working surface during cleaning of the working surface through a frictional contact between the cleaning module and the working surface, which could easily cause dislocation or fall of the cleaning medium.

In an optional embodiment, the connection region and/or the demounting region are/is arranged in at least a pair of two opposite ends of the main body. At least two opposite ends of the main body 101 are provided with the connection region 1020. The connection region 1020 is at least arranged at two opposite ends of the main body 101, thereby effectively fixing the cleaning medium to the main body 101 to avoid crimping. Preferably, the demounting region 1024 is arranged at two opposite ends of the main body 101. The arrangement of the demounting region 1024 at two opposite ends of the main body 101 facilitates cooperation with the cleaning medium demounting structure, thereby realizing more convenient cleaning medium demounting.

Figure 3:
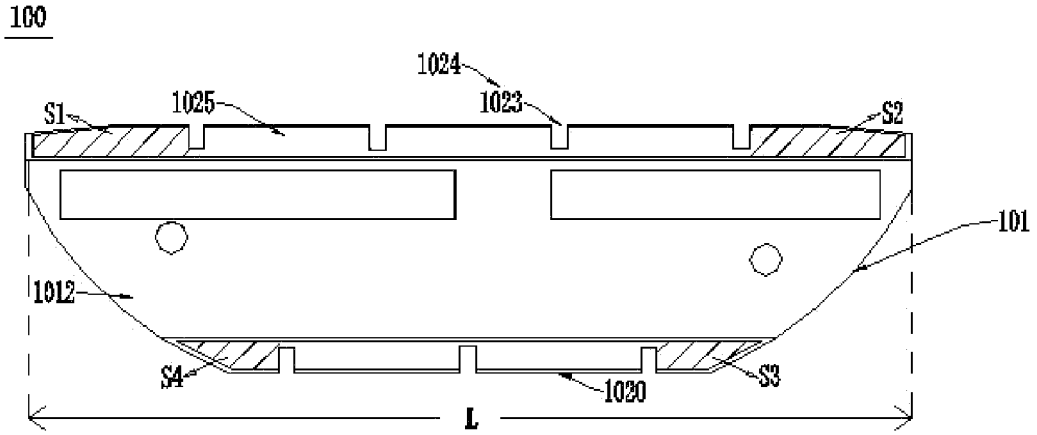
FIG. 3 is a bottom view of the cleaning module of FIG. 1.
Figure 4:
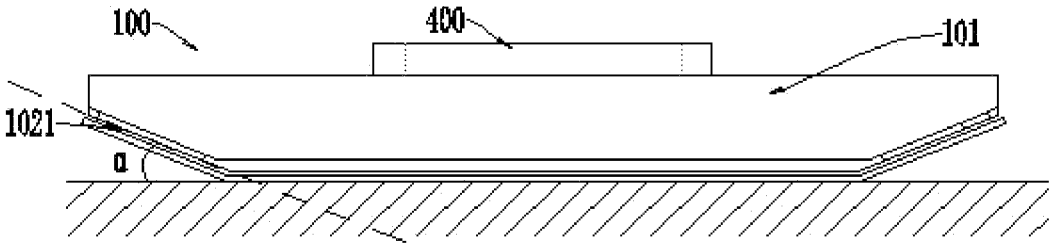
FIG. 4 is a schematic side view of the cleaning module of FIG. 1 connected with a cleaning medium on a working face.

Further, the main body at least includes a pair of opposite long ends L1, L2, and the connection region 1020 and/or the demounting region 1024 are/is at least partially arranged on the opposite long ends L1, L2. With reference to FIG. 3, the connection region 1020 is arranged on the opposite long ends L1, L2. The arrangement of the connection region 1020 on the opposite long ends L1, L2 lengthens the span of the connection region 1020, thereby realizing firmer adhesion of the cleaning medium. Further, with reference to FIG. 1, two ends of the opposite long ends respectively include two head portions 1028, and the head portions 1028 are provided with the connection region 1020. Since the connection region 1020 is arranged at the head portions 1028, the cleaning medium may adhere to corners of the main body 101 during adhesion, thereby further avoiding edge crimping of the cleaning medium in a cleaning process of the cleaning robot 600, which influences the cleaning effect. Preferably, the demounting region 1024 is arranged on the opposite long ends L1, L2. The demounting region 1024 is similarly arranged on the opposite long ends L1, L2, thereby lengthening the span of the demounting region 1024. Thus, a demounting force applied to the cleaning medium may be further dispersed during demounting of the cleaning medium, thereby further facilitating demounting of the cleaning medium and reducing a possibility of tearing the cleaning medium. Meanwhile, the demounting region 1024 may also be closer to the connection region 1020, so that it is more labor-saving to demount the cleaning medium, and tearing of the cleaning medium may be avoided.

Of course, in an optional embodiment, the main body at least includes a pair of opposite short ends L3, L4, and the connection region 1020 and/or the demounting region 1024 are/is at least partially arranged on the opposite short ends L3, L4.

Figure 22:
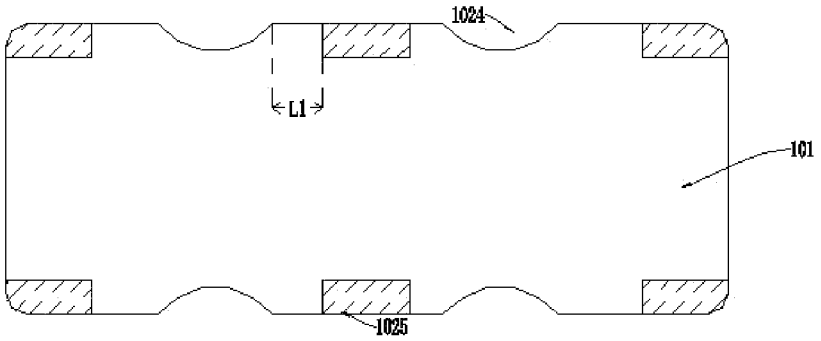
FIG. 22 is a top view of an embodiment of the cleaning module of the disclosure.

In an optional embodiment, the connection region 1020 is spaced apart from the demounting region 1024. With reference to FIG. 22, when the cleaning medium is demounted from the main body 101, the spaced-apart arrangement of the demounting region 1024 further disperses the demounting force applied to the cleaning medium, thereby avoiding tearing the cleaning medium; and the spaced-apart arrangement of the connection region 1020 may realize better adhesion of the cleaning medium to the main body 101.

Figure 23:
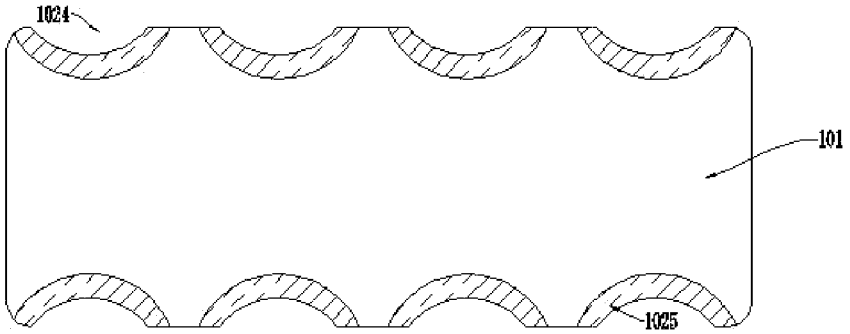
FIG. 23 is a top view of another embodiment of the cleaning module of the disclosure.
Figure 24:
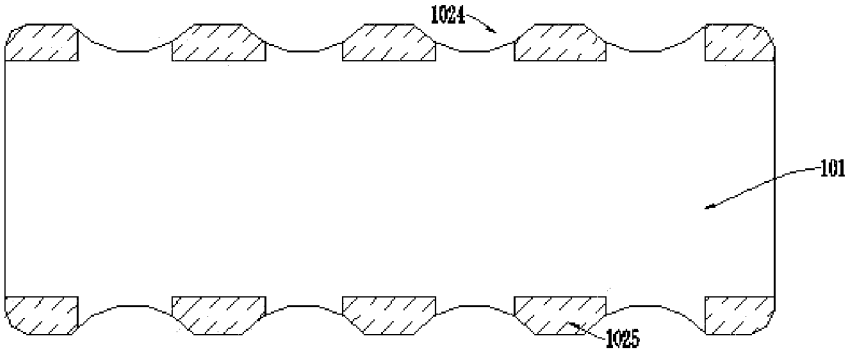
FIG. 24 is a top view of still another embodiment of the cleaning module of the disclosure.

In an optional embodiment, the connection region 1020 is adjacent to the demounting region 1024, and a distance L between adjacent outer edges of the connection region 1020 and the demounting region 1024 is in a preset range. With reference to FIG. 22, the preset range of the distance L between the outer edge of the connection region 1020 and the outer edge of the demounting region 1024 is correlated with sizes of the main body 101, the connection region 1020, and the demounting region 1024. In this embodiment, the preset range may be 0-20 mm. Preferably, the preset range may be 0-3 mm. With this arrangement, when the cleaning medium is demounted from the main body 101, an application point for demounting the cleaning medium is close to the connection region 1020, thereby facilitating application of a force and avoiding a situation that the connection region 1020 cannot be completely separated from the cleaning medium due to tearing of the cleaning medium. Alternatively, the outer edge of the connection region 1020 and the outer edge of the demounting region 1024 are at least partially contiguous. With reference to FIG. 23 and FIG. 24, the outer edge of the connection region 1020 and the outer edge of the demounting region 1024 are contiguous, thereby further facilitating application of the force to the cleaning medium during demounting.

Further, the number of the demounting regions 1024 is two or more. When the cleaning medium is demounted from the main body 101, the demounting force applied to the cleaning medium is further dispersed, thereby avoiding easy tearing of the cleaning medium due to existence of only one application point.

Figure 2:
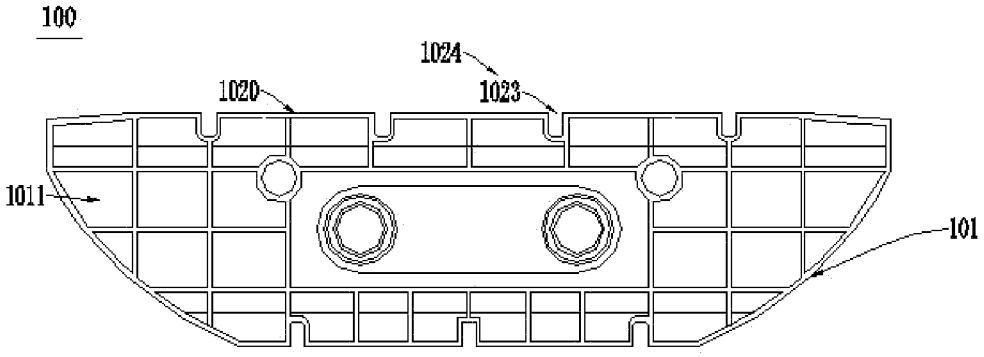
FIG. 2 is a top view of the cleaning module of FIG. 1.

Furthermore, as shown in FIG. 1, FIG. 2, and FIG. 3, the connection region 1020 arranged at one end of the main body 101 is a whole. Projections of the two or more demounting regions 1024 to a lateral direction of the main body form first projections 1026. A projection of the connection region 1020 to the lateral direction of the main body forms a second projection 1027. The first projections 1026 and the second projection 1027 at least partially overlap. With reference to FIG. 1, the second projection 1027 is intact. The second projection 1027 completely covers the first projections 1026, and the first projections 1026 are dispersed over the second projection 1027. At this point, the connection region 1020 is a whole with no break point in the middle, so that the cleaning medium can more firmly adhere to the main body 101. Thus, when the cleaning module works to wipe a floor, the cleaning medium is less prone to crimping, thereby providing a better cleaning effect. Since the demounting regions 1024 are dispersed on the whole connection region 1020, the demounting force may be dispersed on the cleaning medium during demounting of the cleaning medium, thereby avoiding tearing of the cleaning medium, which leads to incomplete separation of the cleaning medium. Preferably, the first projections 1026 are evenly distributed over the second projection 1027. It can be understood that the two or more demounting regions 1024 are evenly distributed over the whole connection region 1020. The even distribution of the two or more demounting regions 1024 over the connection region 1020 may enable application points of the demounting force for demounting the cleaning medium to be distributed on the cleaning medium more evenly, thereby having a reduced possibility of tearing the cleaning medium and facilitating demounting of the cleaning medium.

Alternatively, the number of the connection regions 1020 is two or more, and the connection regions 1020 are mutually non-contiguous. With reference to FIG. 22 to FIG. 24, when the cleaning medium is mounted, an adhesion force is sufficient to fix the cleaning medium to the main body 101 due to the arrangement of a plurality of connection regions 1020; and when the cleaning medium is demounted, the cleaning medium may be demounted more easily because the connection regions 1020 are mutually non-contiguous.

In an optional embodiment, a plurality of connection regions are formed between adjacent ends of the main body, and at least two or more of the connection regions are arranged as the connection regions 1020. With reference to FIG. 3, connection regions S1, S2, S3, and S4 are formed between adjacent ends of the main body, and all of the connection regions S1, S2, S3, and S4 are arranged as the connection regions 1020. The arrangement of the connection regions S1, S2, S3, and S4 as the connection regions 1020 may realize better connection of the cleaning medium to the main body, thereby avoiding crimping of the cleaning medium. Of course, the shape and the size of the connection region are not limited. The shape may be a regular pattern, for example a circle taking a connection point of adjacent ends of the main body as a center of circle and having a radius of a certain length, and a projection of the circle to the main body is arranged as the connection region. The connection region may also be of an irregular pattern.

As shown in FIG. 5 to FIG. 10, a cleaning module 100 of a second embodiment of the disclosure includes a main body 101. The main body includes a body and turnover pieces 102. The turnover pieces 102 are connected to the body and rotate relative to the body, and a connection region 1020 and a demounting region 1024 are arranged on the turnover pieces 102. The connection region 1020 has an adhesion face 1021, and the main body 101 has a working face 1012 to be in contact with a working surface so as to execute a cleaning task. A cleaning medium is connected to the adhesion face 1021 and the working face 1012. It should be noted that the arrangement mode of the demounting region 1024 and the connection portion 1020 in the first embodiment also applies to this embodiment, except that the connection portion 1020 and the demounting region 1024 are arranged on the turnover pieces 102 in this embodiment.

Figure 9:
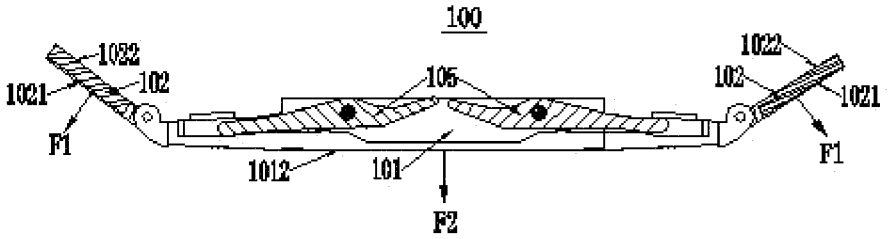
FIG. 9 is a schematic structural view along a section A-A of FIG. 8.

In an optional embodiment, the main body 101 is present as a rectangular plate-like structure having a length direction and a width direction, and a cleaning robot drives the cleaning module 100 to move in the width direction. In this way, the cleaning module 100 affords a large sweeping area for a single movement, thereby having a high cleaning efficiency. As shown in FIG. 9, the main body 101 has the working face 1012 connectable with the cleaning medium, and the working face 1012 corresponds to a lower surface of the main body 101 of the cleaning module 100 in an in-use state. The main body 101 further has a first face 1011 opposite to the working face 1012, and the first face 1011 corresponds to an upper surface of the main body 101 of the cleaning module 100 in the in-use state. The term "in-use state" refers to a state in which the cleaning module 100 mounted on the cleaning robot executes a cleaning operation.

Figure 5:
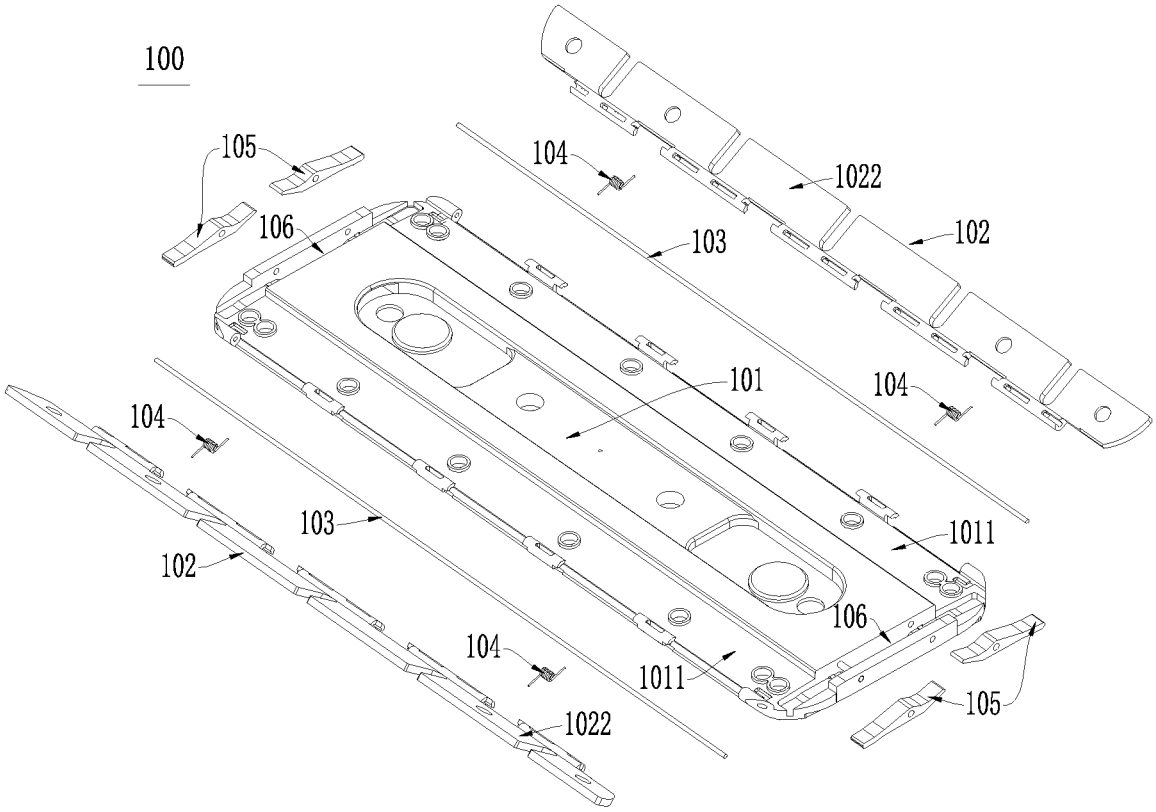
FIG. 5 is a schematic three-dimensional exploded structural view of a cleaning module of a second embodiment of the disclosure.

The turnover pieces 102 are each present as a plate or a bar, and are arranged at two ends (front and back ends) of the main body 101 along its width direction. As shown in FIG. 5, the turnover pieces 102 are rotatably connected with the main body 101 through rotating shafts 103. Preferably, the number of the turnover pieces 102 is two, and they are symmetrically arranged at the front and back ends of the main body 101. The connection region 1020 is arranged on the turnover pieces 102. The connection region 1020 is provided with the adhesion face 1021, and the adhesion face 1021 corresponds to an upper surface of the turnover piece 102 of the cleaning module 100 in the in-use state. The turnover piece 102 further has a second face 1022 opposite to the adhesion face 1021, and the second face 1022 corresponds to the upper surface of the turnover piece 102 of the cleaning module 100 in the in-use state.

Since the turnover piece 102 may rotate relative to the main body 101 (as can be seen from the following, the turnover piece 102 may turn inwards or outwards relative to the main body 101), orientations of the adhesion face 1021 and the second face 1022 may vary when the turnover piece 102 is in different positional states (a closed state and an open state, as described below) relative to the main body 101. Specifically, as shown in FIG. 9, in a specific embodiment, when the turnover piece 102 is in the closed state (generally corresponding to the cleaning module 100 being in the in-use state), the adhesion face 1021 points upwards, and the second face 1022 points downwards. Conversely, when the turnover piece 102 is in the open state (generally corresponding to the cleaning module 100 being in a replacement state of replacing the cleaning medium), the adhesion face 1021 points downwards, and the second face 1022 points upwards. Therefore, it is necessary to emphasize above the orientations of the adhesion face 1021 and the second face 1022 when the cleaning module 100 is in either state or the turnover piece 102 is in either state.

Relative to the main body 101, the turnover piece 102 has a first state and a second state. When the turnover piece 102 is in the first state, a first angle is formed between the adhesion face 1021 and the working face 1012. When the turnover piece 102 is in the second working state, a second angle is formed between the adhesion face 1021 and the working face 1012. The first angle is different from the second angle. That is to say, when the turnover piece 102 is in different working states, its positional relationship with the main body 101 is different. The transition of the positional relationship is realized by rotation of the turnover piece 102.

Figure 6:
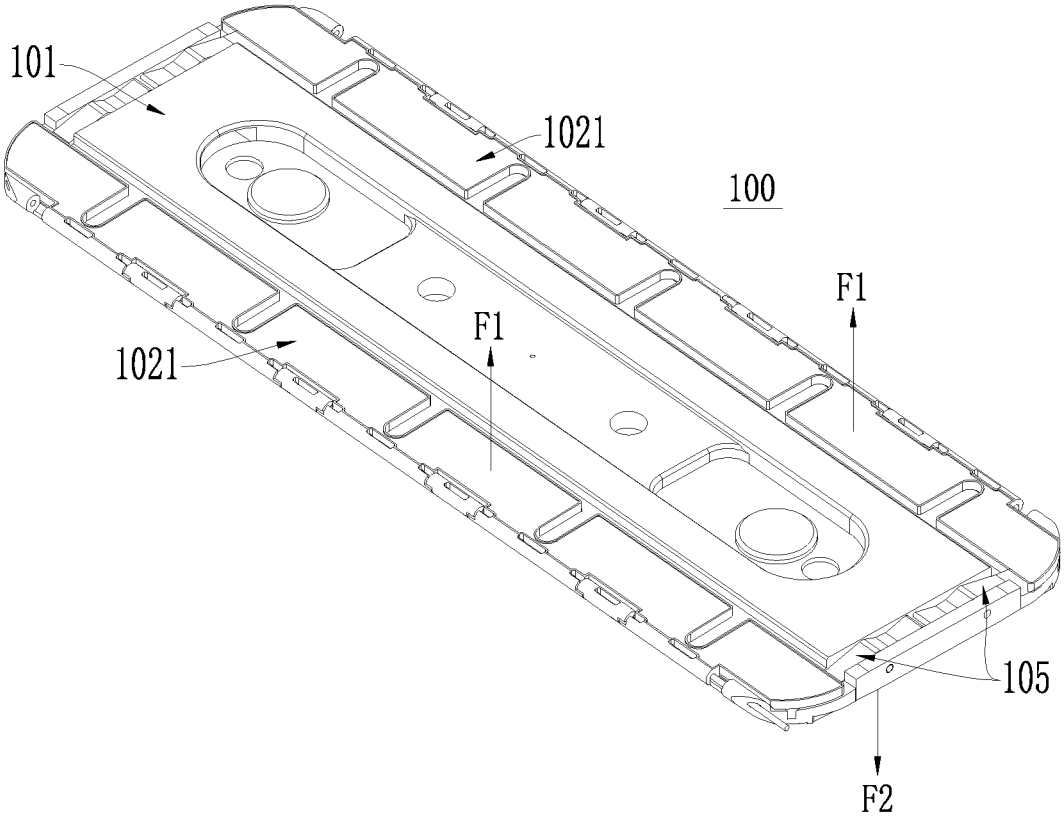
FIG. 6 is a schematic three-dimensional structural view of the cleaning module of the second embodiment of the disclosure in a closed state.
Figure 7:
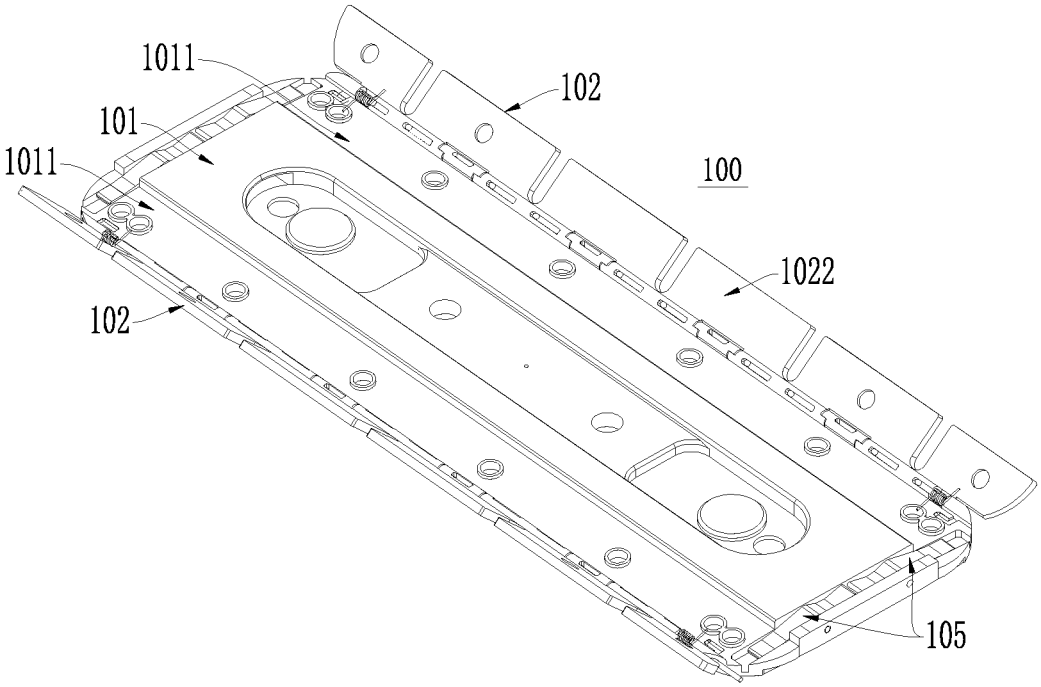
FIG. 7 is a schematic three-dimensional structural view of the cleaning module of the second embodiment of the disclosure in an open state.

To continue from the above description, because the turnover piece 102 is rotatably connected with the main body 101, the turnover piece 102 has the closed state (as shown in FIG. 6) and the open state (as shown in FIG. 7) relative to the main body 101. In this embodiment, the first state is the open state, and the second state is the closed state. When being in the open state, the adhesion face 1021 and the working face 1012 point to a same side of the main body 101. When being in the closed state, the adhesion face 1021 and the working face 1012 point to two sides substantially opposite to each other.

Using geometry, an included angle between two planes is an intersecting plane angle. According to the definition of the intersecting plane angle (dihedral angle), an included angle between the adhesion face 1021 and the working face 1012 is in a range of [0,180] degrees. Based on the correspondence relationship between the above first state and second state and the working state of the turnover piece 102 as well as the positional relationship between the open state and the closed state, it can be known that the first angle is greater than the second angle. In a certain scenario, the first angle may be 0 degree, and the second angle may be an obtuse angle or even a straight angle.

Because the turnover piece 102 rotates relative to the main body 101, the position of the main body 101 is relatively unchanged. Therefore, when the turnover piece 102 is in different states, the orientations of the working face 1012 and the first face 1011 of the main body 101 are unchanged, but the orientations of the adhesion face 1021 and the second face 1022 of the turnover piece 102 vary. Accordingly, mounting and release of the cleaning medium are realized.

Specifically, when the turnover piece 102 is in the open state, the second face 1022 of the turnover piece 102 is separated from the first face 1011 (specifically, the upper surface), the adhesion face 1021 rotates to one and the same side where the working face 1012 of the main body 101 is located, and the cleaning medium may be detached by an external force. When the turnover piece 102 is in the closed state, the second face 1022 of the turnover piece 102 abuts against the first face 1011 of the main body 101, and the adhesion face 1021 rotates until the adhesion face and the working face 1012 of the main body 101 are located at two sides of the main body 102, thereby tensioning the cleaning medium.

In this embodiment, when the turnover piece 102 is in the open state, the adhesion face 1021 and the working face 1012 point to the same side of the main body 101. Specifically, an included angle between a normal direction F1 of the adhesion face 1021 and a normal direction F2 of the working face 1012 may be an acute angle. Specifically, as shown in FIG. 9, both the adhesion face 1021 and the working face 1012 point downwards. The term "normal direction" refers to a direction perpendicular to a face and pointing outwards.

In an optional embodiment, as illustrated in FIG. 9, the turnover piece 102 is in the open state, the normal direction F2 of the working face 1012 is vertically downward, and the normal direction F1 of the adhesion face 1021 is obliquely downward. Specifically, the working face 1012 points downwards vertically, and the adhesion face 1021 points downwards obliquely. In a further embodiment, an included angle of substantially 150 degrees is formed between the upper surface of the turnover piece 102 and the upper surface of the main body 101, so that the included angle between the normal direction of the adhesion face 1021 and the normal direction of the working face 1012 is 30 degrees. The turnover piece 102 rotates outwards by 150 degrees from the closed state to the open state.

Described above is an embodiment in which the adhesion face 1021 of the turnover piece 102 is obliquely downward. However, in practice, the state of the turnover piece 102 is not limited to the above embodiment. In another optional embodiment, the normal direction F1 of the adhesion face 1021 may also be vertically downward. At this point, the adhesion face 1021 is parallel to or even flush with the working face 1012, and the normal directions F1, F2 both are parallel.

Likewise, when the turnover piece 102 is in the closed state, the adhesion face 1021 and the working face 1012 point to two opposite sides of the main body 101. Specifically, the included angle between the normal direction F1 of the adhesion face 1021 and the normal direction F2 of the working face 1012 may be an obtuse angle. Specifically, as shown in FIG. 6, the adhesion face 1021 points upwards, and the working face 1012 points downwards. In a further preferred embodiment, the adhesion face 1021 points upwards vertically, the working face 1012 points downwards vertically, and the included angle between the normal directions F1, F2 is 180 degrees.

In this embodiment, when being switched from the closed state to the open state, the turnover piece 102 turns outwards. When being switched from the open state to the closed state, the turnover piece 102 turns inwards. A surface of the turnover piece 102 opposite to the second face 1022 is provided with an adhesion structure capable of realizing adhesion of the cleaning medium, to form the adhesion face 1021. The adhesion structure includes VELCRO® tapes, hook-and-loop tapes, etc. When the turnover piece 102 is switched from the open state to the closed state, the adhesion face 1021 drives the cleaning medium to turn inwards so as to tension the cleaning medium.

Figure 20A:
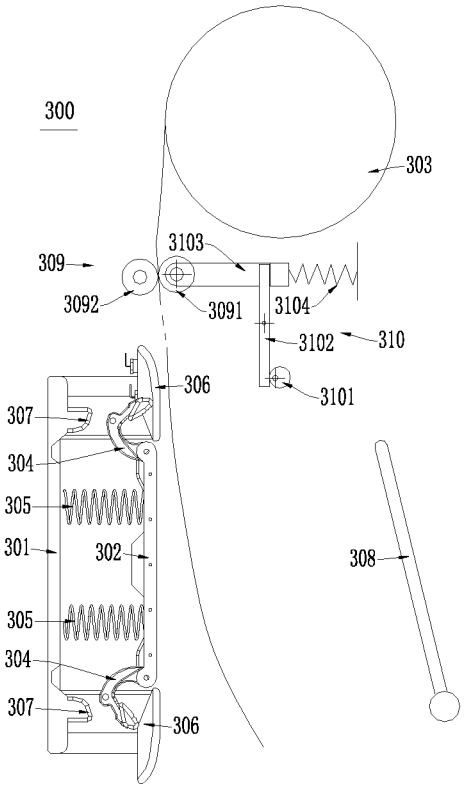
FIG. 20A to FIG. 20F are procedure views showing that a cleaning medium mounting device of an embodiment of the disclosure mounts the cleaning medium for the cleaning module.
Figure 20B:
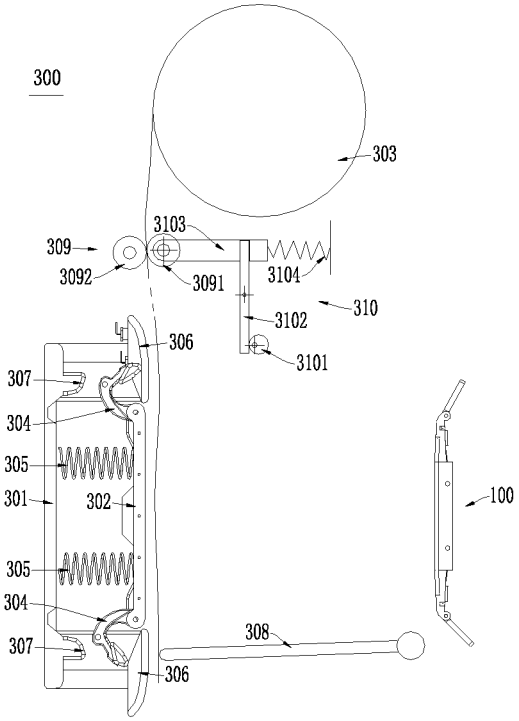
Figure 20C:
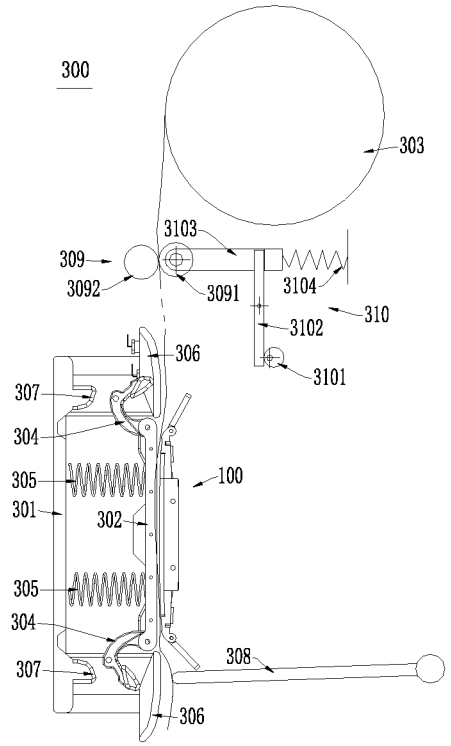
Figure 20D:
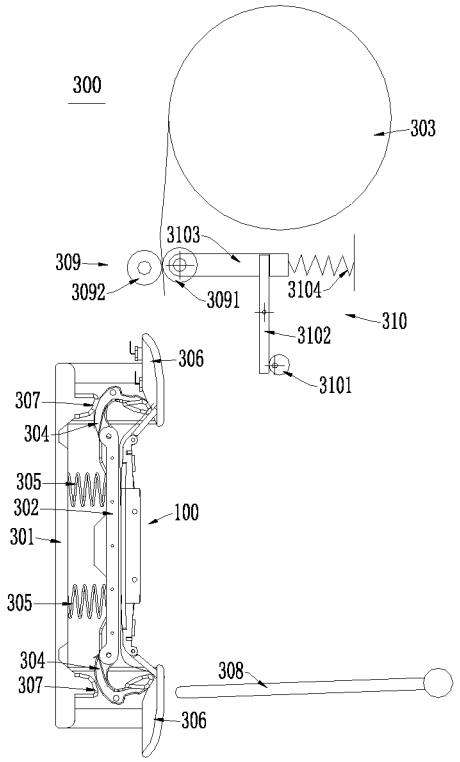
Figure 20E:
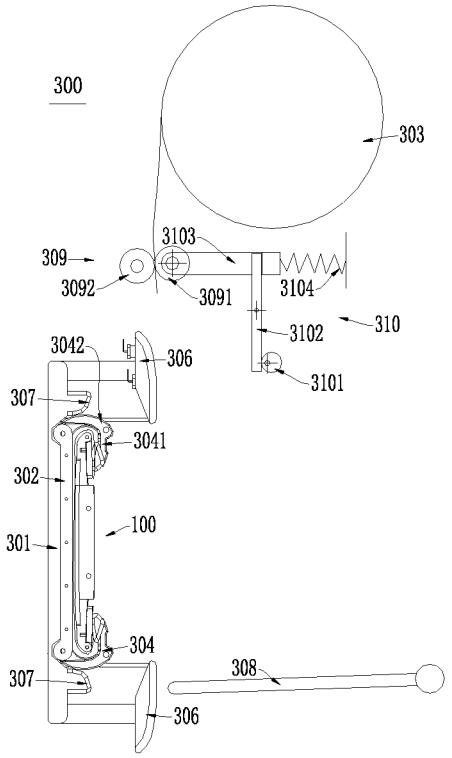

Specifically, as shown with respect to FIG. 20D and FIG. 20E, when gripping jaws 304 of a cleaning medium mounting device 300 first press the cleaning medium on the adhesion face 1021 of the turnover piece 102, the cleaning medium fixedly adheres thereto. The gripping jaws 304 then force the turnover piece 102 to turn inwards. In the turning process, the adhesion face 1021 along with the pulled cleaning medium moves inwards, thereby realizing tensioning.

Through the above structural design, the cleaning medium in a tensioned state may be in better contact with the working surface in the subsequent cleaning process, thereby avoiding crimping or folding in the working surface contact process due to relaxation of the cleaning medium, which in turn influences the cleaning effect.

Thus, when the turnover piece 102 is in the open state, the adhesion face 1021 for adhesion of the cleaning medium and the working face 1012 of the main body 102 for connection of the cleaning medium are located at the same side of the main body 101. In this way, after the cleaning medium is mounted on the working face 1012 of the main body 102 and adheres to the adhesion face 1021, the whole is in a state of being relatively relaxed. Subsequently, in a process of being switched to the closed state, the turnover piece 102 rotates towards the inner side of the main body 101. By means of the adhesion and fixation of the adhesion face 1021 to the cleaning medium, adhering portions of the cleaning medium are driven all together to move inwards, thereby tensioning the cleaning medium.

Likewise, after the turnover piece 102 is switched from the closed state to the open state, the cleaning medium returns to the relaxed state from the tensioned state, thereby conveniently realizing demounting of a dirty cleaning medium.

As shown in FIG. 5 to FIG. 9, in an optional embodiment, the turnover piece 102 is made of a hard material, such as plastics, a metal, etc.; and the whole is rigid, and has no flexibility and elasticity or has poor flexibility and elasticity. In order to enable such hard turnover piece 102 to be switched to the open state or the closed state, the cleaning module 100 further includes a closure maintainer and an opening executer. The closure maintainer is configured to apply a closure maintenance force to the turnover piece 102 so as to maintain the turnover piece in the closed state or move it towards the closed state. The opening executer is configured to apply an opening execution force to the turnover piece 102 so as to maintain the turnover piece 102 in the open state or move it towards the open state. That is to say, the closure maintainer is configured to maintain the turnover piece 102 in the closed state so as to tension the cleaning medium, thereby avoiding slippage of the cleaning medium in the cleaning process. The opening executer is configured to open the turnover piece 102 to loosen the cleaning medium, so that a dirty cleaning medium may be demounted and replaced with a clean cleaning medium.

In a feasible embodiment, the closure maintainer includes a first attachment element arranged on the main body 101 (specifically, first face 1011), and a second attachment element arranged on the turnover piece 102 (specifically, second face 1022) and corresponding to the first attachment element. One of the first attachment element and the second attachment element is a magnetic element, and the other is a magnetizable element or a magnetic element. The closure maintenance force is a magnetic attraction force produced between the first attachment element and the second attachment element.

In this embodiment, the magnetic element may be an element having magnetism and capable of producing a magnetic field, for example it may be a magnet (e.g., a permanent magnet or a hard magnet) having magnetism per se and may also be an electromagnetic element (e.g., an electromagnet) capable of producing magnetism after being electrified. The magnetizable element may be made of a magnetizable material such as iron, cobalt, nickel, etc., and it can be attracted by a magnetic force. When both the first attachment element and the second attachment element are magnetic elements, magnetic poles of the two magnetic elements facing each other are different.

The opening executer includes a lever 105 rotatably arranged on the main body. The lever has a stressed end and an acting end. A rotatable connection point for the lever 105 and the main body 101 is located between the stressed end and the acting end. The stressed end receives an external force to drive the lever 105 to rotate. The acting end corresponds to the second face 1022. The opening execution force is a mechanical pushing force applied by the acting end to the second face 1022.

As shown in FIG. 5 to FIG. 9, there are two groups of levers 105, respectively arranged at two ends (left and right ends) of the main body 101 along its length direction. Each group includes two levers 105, respectively configured to correspond to the turnover pieces 102 at the front and back ends. In this way, the left and right ends of each turnover piece 102 are respectively lifted by the left and right levers 105, thereby realizing opening.

In order to prevent the lever 105 from interfering with the closure of the turnover piece 102, the upper surface of the main body 101 is recessed inwards near the left and right ends to form grooves 106, two levers located at the same side are rotatably arranged in the same groove 106, and the two levers at the same side are symmetrically arranged. When the acting end of the lever 105 extends out of the groove 106 and lifts the second face 1022 of the turnover piece 102, an outward force is applied to the turnover piece 102, thereby realizing switching from the original closed state to the open state. Correspondingly, when the acting end of the lever 105 retracts into the groove 106, the turnover piece 102 returns to and stably remains in the closed state under the action of the magnetic attraction force between the first attachment element and the second attachment element.

Further, the opening executer further includes a torsion spring 104 arranged between the main body 101 and the turnover piece 102. As shown in FIG. 5, specifically, the torsion spring 104 is sleeved on the rotating shaft 103, and its two ends respectively push against the main body 101 and the turnover piece 102. Thus, the torsion spring 104 applies to the turnover piece 102 a torsional force for enabling the turnover piece to always turn outwards. The opening execution force further includes a torsional force applied by the torsion spring 104 to the turnover piece 102 to turn the turnover piece towards the open state. The number of the torsion springs 104 is preferably two or more. The rotating shaft 103 is at least respectively sleeved with one torsion spring 104 near each of the two ends, so as to balance an effect of resetting the turnover piece 102 along the length direction.

In practice, the lever 105 cooperates with the torsion spring 104 to realize opening of the turnover piece 102. Specifically, the magnetic attraction force between the first attachment element and the second attachment element is correlated with a distance between the first face 1011 and the second face 1022. In a process of the lever 105 pushing the turnover piece 102 to turn outwards, the distance between the first face 1011 and the second face 1022 is gradually increased, and the magnetic attraction force between the first attachment element and the second attachment element is gradually decreased. When the turnover piece 102 turns outwards to a preset position, the torsional force applied by the torsion spring 104 to the turnover piece 102 is greater than the magnetic attraction force between the two attachment elements, so that the torsional force overcomes the magnetic attraction force. The turnover piece 102 continues to turn outwards to the open state.

When the turnover piece 102 is in a closed state, the first face 1011 abuts against the second face 1022. At this point, the distance between the first attachment element and the second attachment element is the minimum, the magnetic attraction force is the maximum, and the magnetic attraction force is greater than the torsional force applied by the torsion spring 104 to the turnover piece 102. Therefore, when being in the closed state, the turnover piece 102 will stably remain in the closed state without the aid of an external force.

Therefore, in this embodiment, the lever 105 is configured to overcome the magnetic attraction force between the first attachment element and the second attachment element at an initial stage. That is to say, the pushing action force applied by the lever 105 to the turnover piece 102 is greater than the maximum magnetic attraction force, thereby starting rotation of the turnover piece 102. When the magnetic attraction force is lowered to be smaller than the torsional force of the torsion spring 104 in a process of the turnover piece 102 rotating outwards, the turnover piece 102 may continue to rotate outwards under the action of the torsion spring 104 and be switched to the open state finally.

Of course, the closure maintainer and the opening executer are not limited to the above embodiments. In another feasible embodiment, the closure maintainer may also realize closure of the turnover piece 102 by the magnetic attraction force of the magnetic element. The difference lies in that the production and disappearance of the magnetic attraction force are controllable in this embodiment.

Specifically, the closure maintainer includes an electromagnetic element arranged on the first face 1011 of the main body 101 and a magnetizable element or a magnet arranged on the second face 1022 of the turnover piece 102 and corresponding to the electromagnetic element, and the closure maintenance force is still a magnetic attraction force. Similarly, the turnover piece 102 is rotatably connected with the main body 101 through the rotating shaft 103. The opening executer is a torsion spring sleeved on the rotating shaft 103, and two ends of the torsion spring respectively push against the main body 101 and the turnover piece 102. The opening execution force is a torsional force. The torsion spring in this embodiment has the same action as the torsion spring 104 in the previous embodiment, to apply the torsional force to the turnover piece 102 so as to enable the turnover piece to turn outwards. When the turnover piece 102 needs to be maintained in the closed state or needs to be switched from the current open state to the closed state, the electromagnetic element is electrified to produce a magnetic field, so that the turnover piece 102 turns inwards under the action of the magnetic attraction force until the magnetizable element or the magnet is adsorbed by the electromagnetic element, thereby realizing closure of the turnover piece 102. When the turnover piece 102 needs to be maintained in the open state or needs to be switched from the current closed state to the open state, the electromagnetic element is de-electrified to make the magnetic field disappear, so that the turnover piece 102 turns outwards under the action of the torsion spring, thereby realizing opening.

Described above is an embodiment in which the turnover piece 102 is made of a hard material. Since the turnover piece 102 does not have preferred flexibility and elasticity, the turnover piece 102 needs to be switched between the closed state and the open state by means of the closure maintainer and the opening executer.

Figure 10:
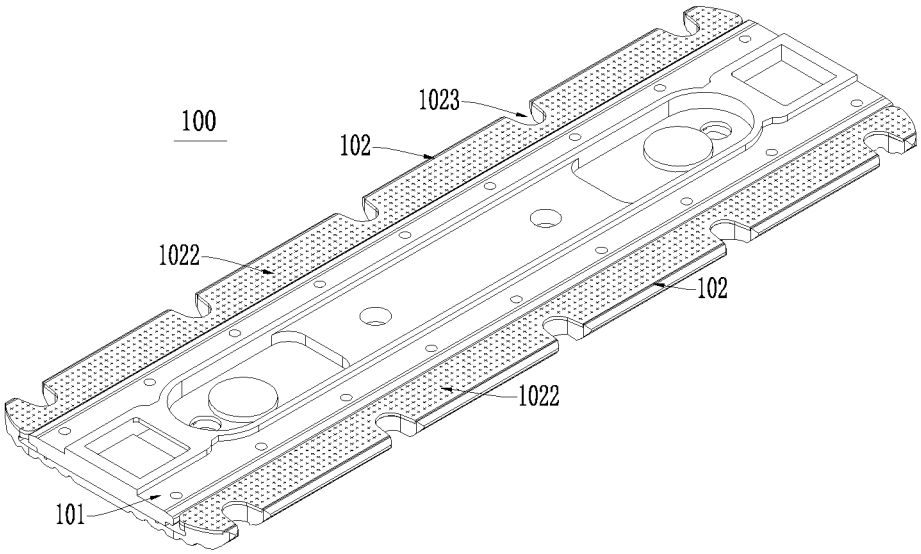
FIG. 10 is a schematic three-dimensional structural view of the cleaning module of the second embodiment of the disclosure.
Figure 11:
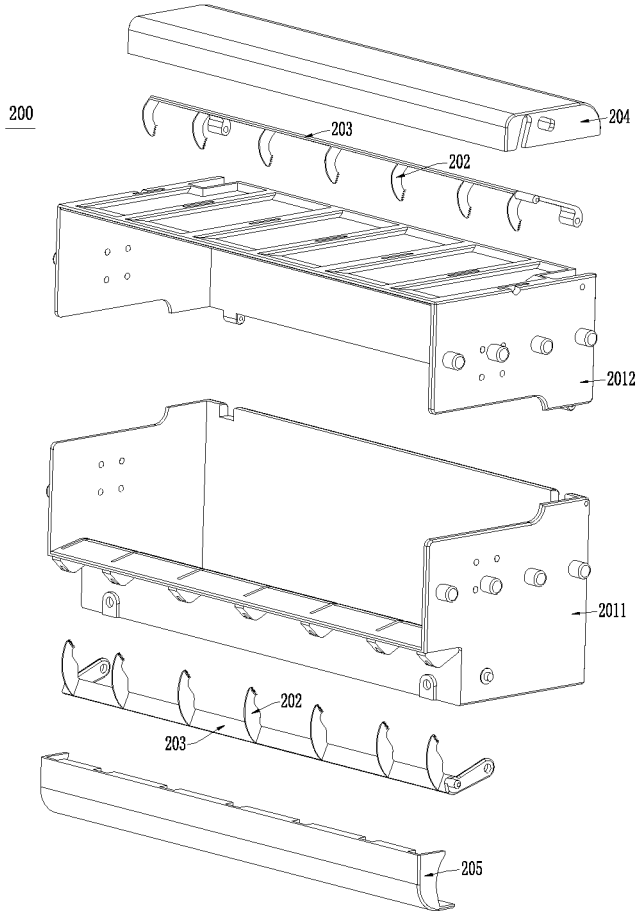
FIG. 11 is a schematic three-dimensional exploded structural view of a cleaning medium collection device of an embodiment of the disclosure.

As shown in FIG. 10, in another optional embodiment, the turnover piece 102 is made of a flexible and elastic material, such as a rubber material. In this way, the turnover piece 102 may be maintained in the closed state by means of its own elasticity. When the cleaning medium receives an external force directed away from the main body 102, the cleaning medium pulls the turnover piece 102 to turn outwards through the adhesion face 1021.

Figure 18A:
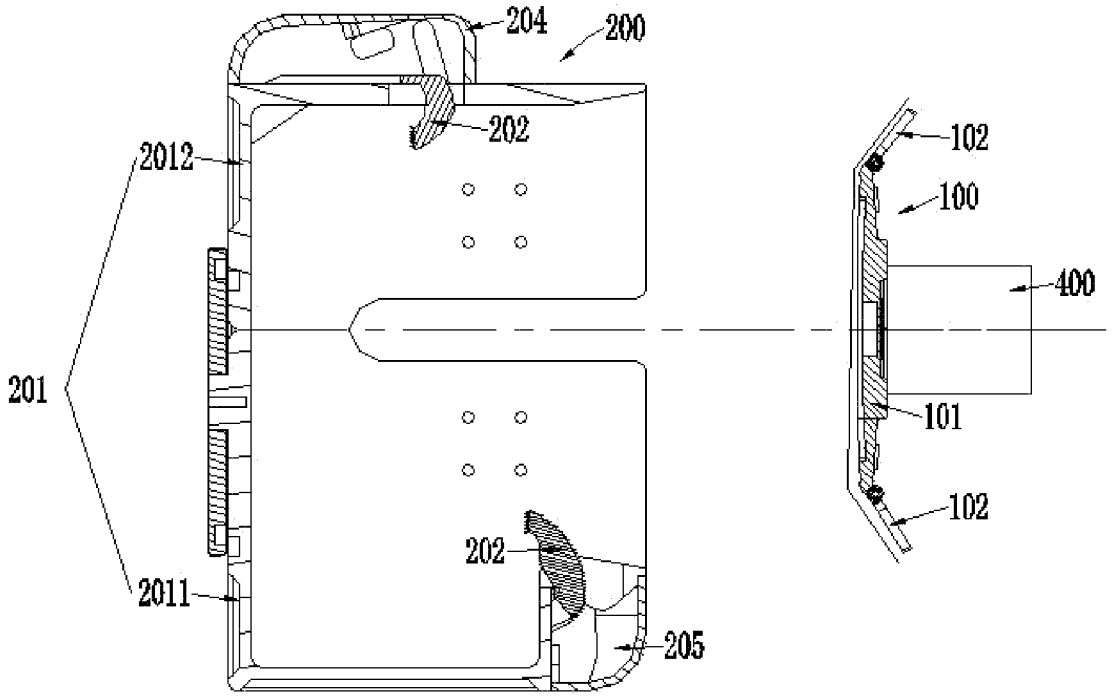
FIG. 18A to FIG. 18C are procedure views showing that the cleaning medium collection device of an embodiment of the disclosure collects the cleaning medium.
Figure 18B:
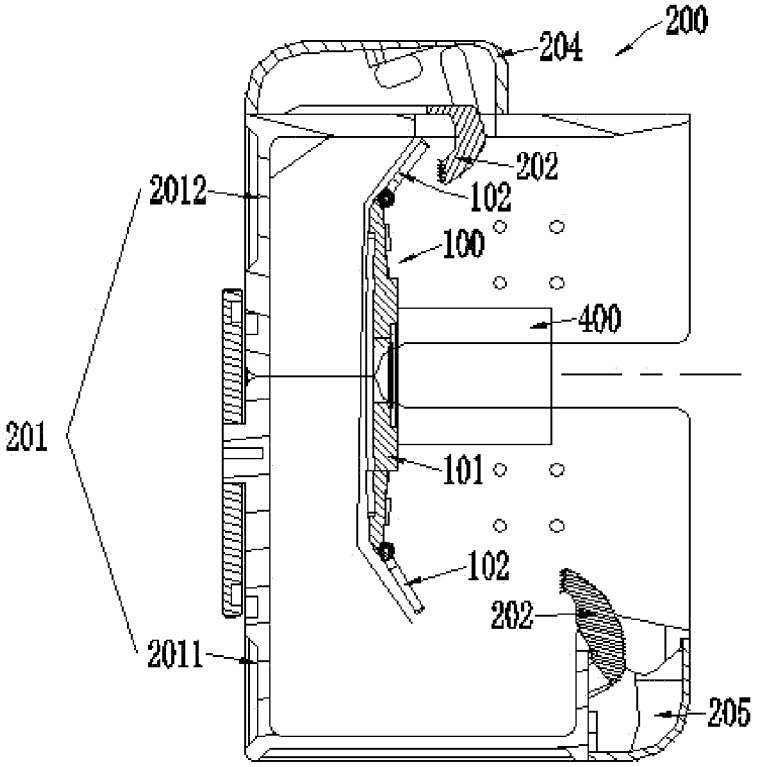
Figure 18C:
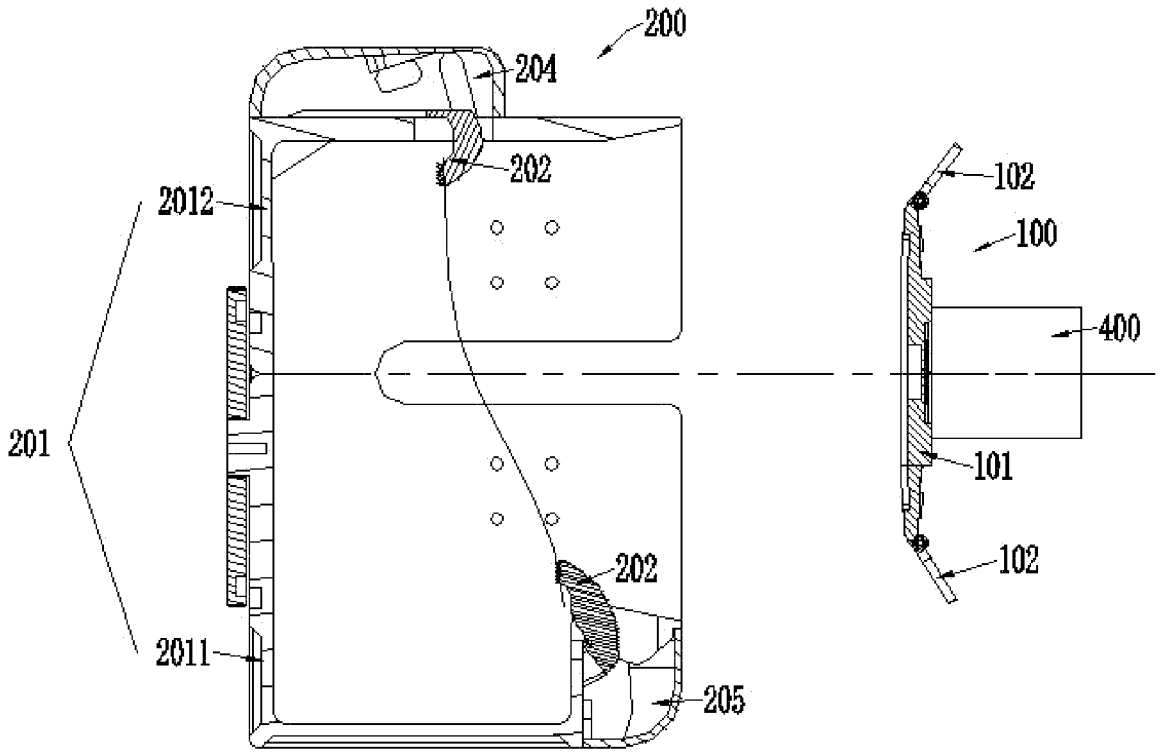

Specifically, as shown in FIG. 18A to FIG. 18C, the cleaning module 100 carrying a dirty cleaning medium moves towards a collection box 201. After the whole cleaning module 100 enters the collection box 201, the cleaning module moves backwards and exits the collection box 201. At this point, the dirty cleaning medium adhering to the adhesion face 1021 of the turnover piece 102 is hooked by paper detaching hooks 202 arranged at two sides of an opening of the collection box 201. With the continued backward movement of the cleaning module 100, the dirty cleaning medium is hung on the paper detaching hooks 202, and the flexible turnover piece 102 is driven to turn outwards (specifically, to be bent outwards) to the open state. Thus, the dirty cleaning medium is torn down from the adhesion face 1021 of the turnover piece 102. Subsequently, the turnover piece 102 returns to the closed state by means of its own flexibility and elasticity.

A base station of an embodiment of the disclosure includes a housing, and the cleaning medium mounting device 300 is arranged on the housing. Since a clean cleaning medium cannot be mounted until the dirty cleaning medium mounted on the cleaning module 100 is demounted, the housing of the base station is further provided with a cleaning medium collection device 200 configured to demount and collect the dirty cleaning medium mounted on the cleaning module 100.

A cleaning robot system of an embodiment of the disclosure includes a cleaning robot 600. The cleaning robot 600 is detachably connected with a cleaning module 100. The cleaning module 100 includes a main body 101, connectable with a cleaning medium to wipe a working surface. The main body 101 is provided with a connection region 1020 for connection of the cleaning medium and a demounting region 1024 for demounting of the cleaning medium, and no interconnection action occurs between the demounting region 1024 and the cleaning medium. The cleaning robot 600 system further includes a base station. The base station includes a housing and a cleaning medium collection device 200, arranged on the housing and configured to demount and collect the cleaning medium mounted on the cleaning module 100. It should be noted that the base station in this embodiment may be adapted to the cleaning module 100 in any of the above embodiments, to separate the cleaning medium on the cleaning module 100 from the main body 101.

As shown in FIG. 11 to FIG. 19C, in an optional embodiment, the cleaning medium collection device 200 includes a separation module. The separation module acts on the cleaning medium covering the demounting region 1024 to separate the cleaning medium from the main body 101. A cleaning medium demounting mechanism of the separation module may be arranged in various forms, such as hooks or gripping tools, but is not limited thereto. Hereinafter, a separation module including paper detaching hooks 202, by way of example, is used to describe how to separate the cleaning medium from the main body 101 in detail.

The cleaning medium collection device 200 further includes a collection box 201, configured to collect the cleaning medium separated by the separation module. The separated cleaning medium is directly collected into the collection box 201, thereby avoiding polluting hands during manual handling of the dirty cleaning medium. In order to enable the dirty cleaning medium to be directly collected into the collection box 201, the collection box 201 is arranged on a moving path of the separated cleaning medium, thereby making the cleaning medium fall into the collection box 201.

The separation module (separator) applies an external force directed away from the main body 101 to the cleaning medium covering the demounting region 1024 to demount the cleaning medium, and the separated cleaning medium falls into the collection box 201 by its own gravity. Optionally, the collection box 201 may be arranged below the separated cleaning medium. In this way, the separated cleaning medium directly falls into the collection box 201 by its own gravity, and the cleaning medium may be collected without the aid of additional structures.

Alternatively, the separation module applies an external force directed away from the main body 101 to the cleaning medium covering the demounting region 1024 to demount the cleaning medium, and the external force pulls the cleaning medium into the collection box 201. The cleaning medium is pulled into the collection box 201 by means of the external force applied by the separation module to demount the cleaning medium, which also realizes collection of the cleaning medium without the aid of additional structures.

Further, the separation module includes paper detaching hooks 202. The paper detaching hooks 202 correspond to the demounting region 1024, hook the cleaning medium covering the demounting region 1024 and apply an external force directed away from the main body 101 to the cleaning medium to separate the cleaning medium from the main body 101. The paper detaching hooks 202 may be arranged on the housing, and may also be arranged on the collection box 201. In this embodiment, the paper detaching hooks 202 are at least partially located in the collection box 201. One side of the collection box 201 is provided with an opening, and the paper detaching hooks 202 are distributed at two sides of the opening. Specifically, the collection box 201 is provided with two shafts (rotating shafts 203, as described below) respectively arranged at two sides of the opening of the collection box 201. The paper detaching hooks 202 are arranged on the rotating shafts 203 to form upper paper detaching hooks and lower paper detaching hooks. There are a plurality of paper detaching hooks 202 arranged on each rotating shaft 203, and the plurality of paper detaching hooks 202 are evenly distributed to improve the efficiency of demounting the dirty cleaning medium.

Figure 25:
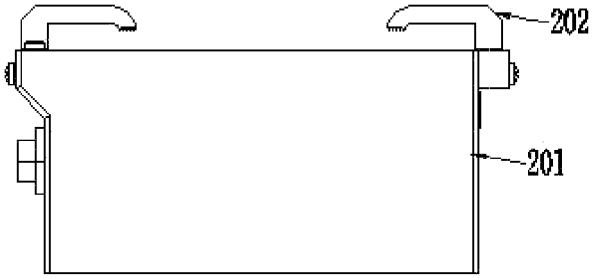
FIG. 25 is a schematic view of paper detaching hooks and a collection box in the disclosure.

In an embodiment, one side of the collection box 201 is provided with an opening, and the paper detaching hooks 202 are arranged outside the opening relative to the collection box 201. Further, with reference to FIG. 25, an upper side of the collection box 201 is provided with an opening, and the paper detaching hooks 202 are arranged above the opening relative to the collection box 201. The specific mode in which the paper detaching hooks 202 are arranged outside the opening relative to the collection box 201 is not limited. For example, the collection box 201 and the paper detaching hooks 202 may be connected to a chassis arranged inside the base station, so that the collection box 201 and the paper detaching hooks 202 are not displaced relative to the chassis during separation of the cleaning medium; or the paper detaching hooks 202 may be directly connected to the outer side of the collection box 201, so that the collection box 201 is not displaced relative to the paper detaching hooks 202.

Figure 16:
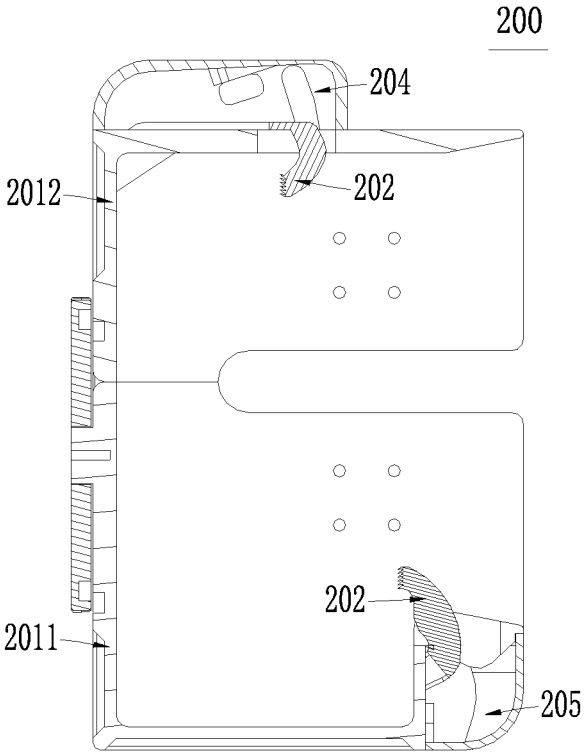
FIG. 16 is a side view of the cleaning medium collection device of an embodiment of the disclosure.
Figure 17:
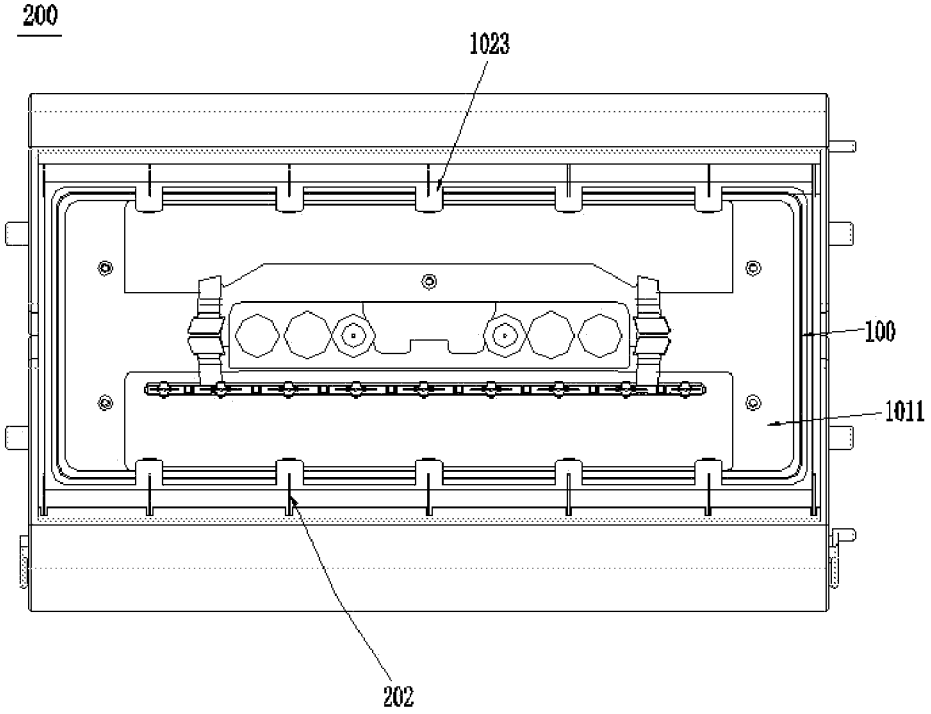
FIG. 17 is a front view showing that the cleaning medium collection device of an embodiment of the disclosure collects the cleaning medium.

As shown in FIG. 16, a back face of the paper detaching hook 202, namely a face pointing to the opening, is a smooth face; and a front face, namely a face opposite to the opening, is provided with saw teeth. In this way, the smooth back face of the paper detaching hook 202 facilitates entry of the cleaning module 100, thereby avoiding blocking and interfering with the cleaning module 100 entering the collection box 201; and the front face provided with the saw teeth may hook the dirty cleaning medium, thereby realizing a preferred demounting effect.

Figure 8:
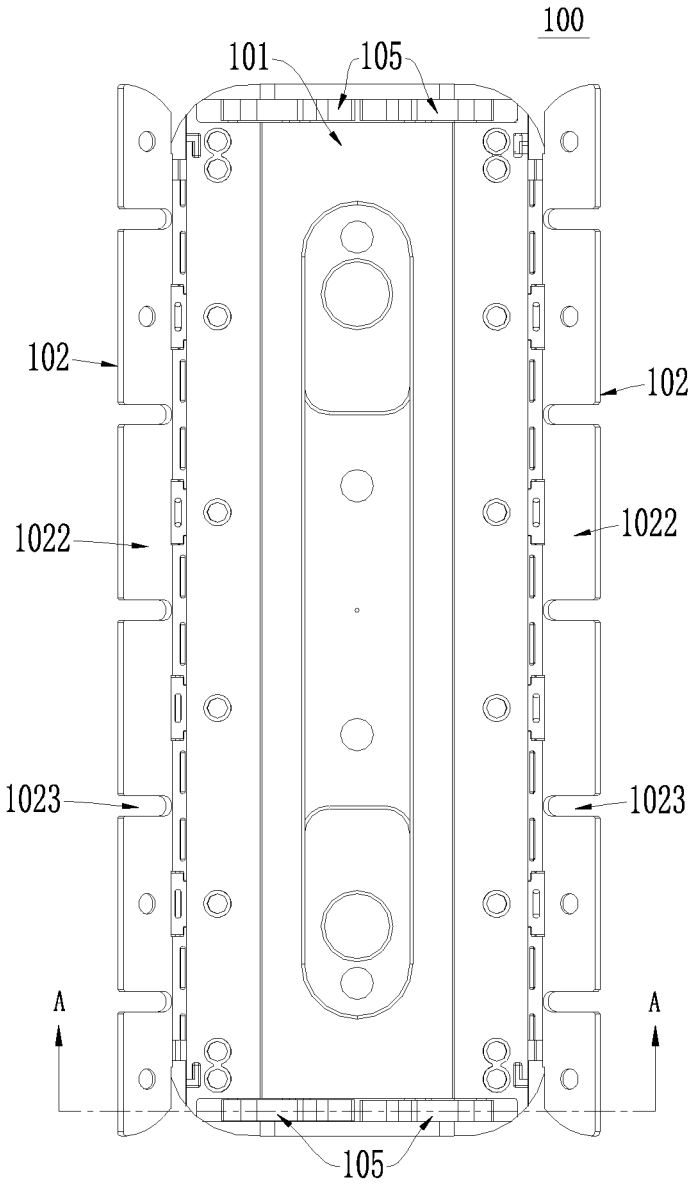
FIG. 8 is a top view of the cleaning module of the second embodiment of the disclosure in the open state.

As shown in FIG. 8 and FIG. 9, in an embodiment, in order to prevent the turnover piece 102 from interfering with and blocking the paper detaching hooks 202 to ensure that the paper detaching hooks 202 can successfully demount the dirty cleaning medium when the dirty cleaning medium is demounted by the paper detaching hooks 202 from the turnover piece 102, the outer side of the turnover piece 102 is provided with notches 1023 corresponding to the paper detaching hooks 202. The paper detaching hooks 202 may travel through the notches 1023 to demount the dirty cleaning medium.

In an embodiment, the cleaning module 100 moves beyond the paper detaching hooks 202; the cleaning module 100 moves reversely, so that the cleaning medium covering the demounting region 1024 is hooked by the paper detaching hooks 202; the cleaning module 100 continues to move; and the cleaning medium is demounted. FIG. 18A to 18C and FIG. 19A to 19C are schematic views showing that the cleaning medium collection device 200 collects the cleaning medium on the cleaning module in the first embodiment and the second embodiment.

As shown in FIG. 18A, when a support device 400 carrying the cleaning module 100 moves towards the opening of the cleaning medium collection device 200, the turnover piece 102 of the cleaning module 100 is in an open state, and the dirty cleaning medium originally adhering to the adhesion face 1021 of the turnover piece 102 is in a relaxed state. The support device 400 applies a force to a stressed end of a lever 105, thereby opening the turnover piece 102. As shown in FIG. 18B and FIG. 18C, after the support device 400 carrying the opened cleaning module 100 moves beyond the two paper detaching hooks 202 to enter the collection box 201, the support device 400 moves backwards. In this way, the dirty cleaning medium that has been loosened but still adheres to the gripping piece 102 is hooked by the paper detaching hooks 202. Subsequently, the cleaning module 100 continues to move backwards to exit the collection box 201, and the dirty cleaning medium is hung on the paper detaching hooks 202 and left in the collection box 201, thereby realizing demounting and collection of the dirty cleaning medium. As shown in FIG. 11 to FIG. 14, the collection box 201 includes a lower housing 2011, and an upper housing 2012 rotatably connected with the lower housing 2011. In this way, the collection box 201 may be opened to facilitate removal of the dirty cleaning medium collected therein.

Figure 19A:
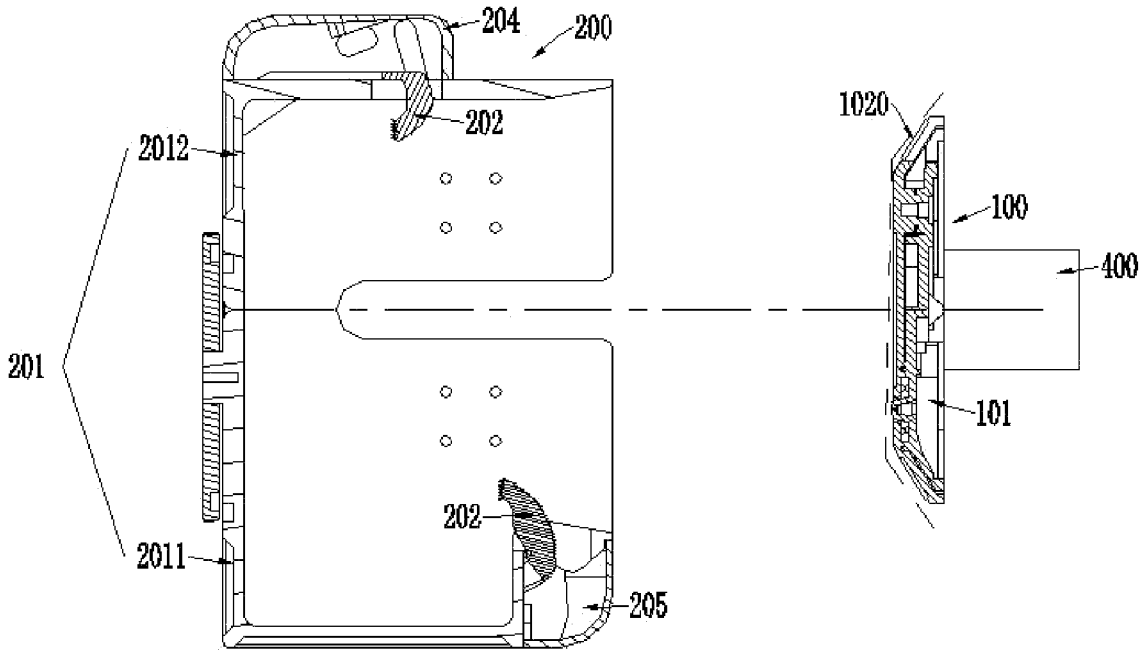
FIG. 19A to FIG. 19C are procedure views showing that the cleaning medium collection device of another embodiment of the disclosure collects the cleaning medium.
Figure 19B:
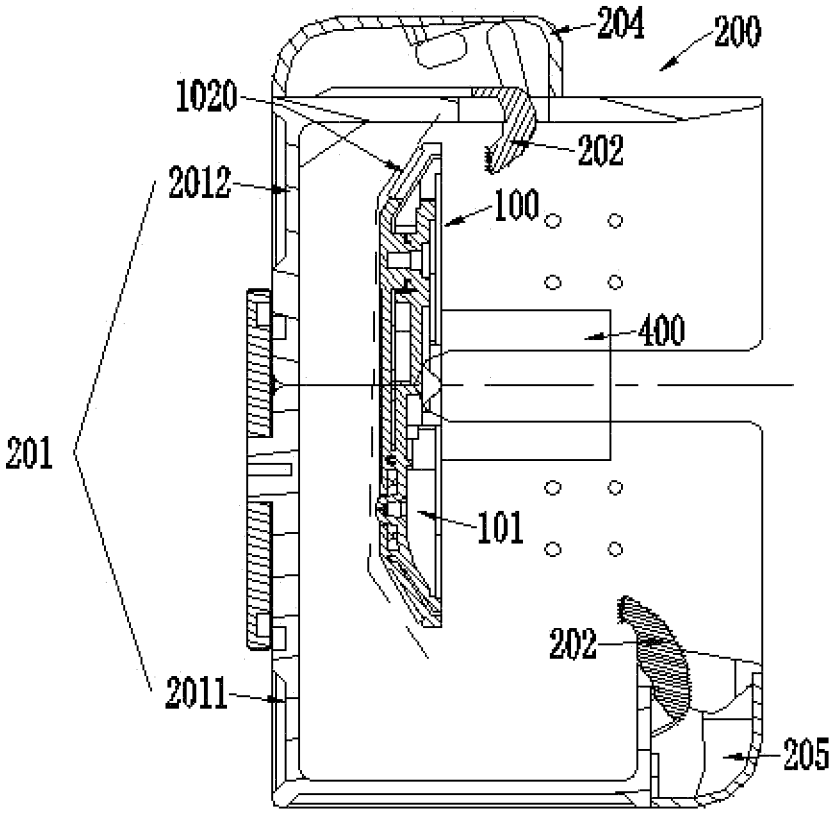
Figure 19C:
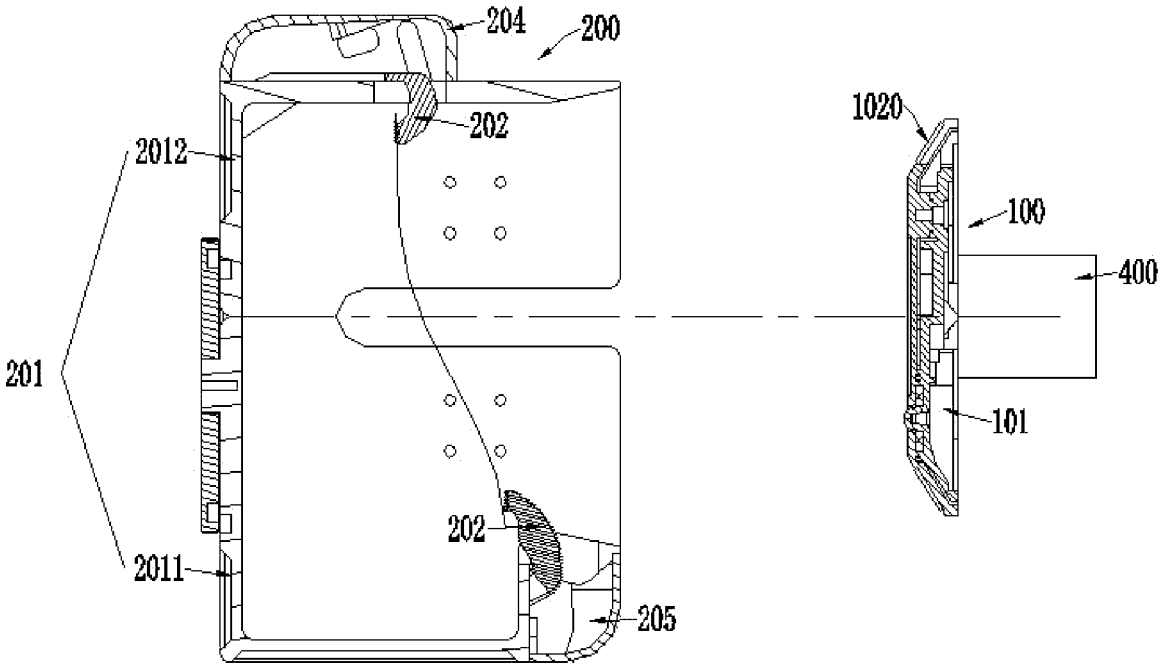

FIG. 19A to FIG. 19C are procedure views showing that the cleaning medium collection device 200 collects the cleaning medium on the cleaning module 100 in the first embodiment of the disclosure. The structure of the cleaning medium collection device 200 is substantially the same as that described above, and will not be described in detail here.

The paper detaching hooks 202 correspond to the demounting region 1024, hook the cleaning medium covering the demounting region 1024 and apply an external force directed away from the main body 101 to the cleaning medium to separate the cleaning medium from the main body 101. The separated cleaning medium is collected into the collection box 201. When the cleaning medium connected to the cleaning module 100 is demounted, the paper detaching hooks 202 are aligned with the demounting region 1024 to make the paper detaching hooks travel through the demounting region 1024 and hook the cleaning medium covering the demounting region 1024. At this point, the cleaning module 100 moves away from the paper detaching hooks 202, and the paper detaching hooks 202 limit movement of the cleaning medium covering the demounting region 1024. The cleaning module 100 continues to move away from the paper detaching hooks 202, so that the cleaning medium will be pulled by the paper detaching hooks 202. Since no interconnection action occurs between the demounting region 1024 and the cleaning medium, the paper detaching hooks 202 may easily pull off the cleaning medium from the main body 101.

Figure 12:
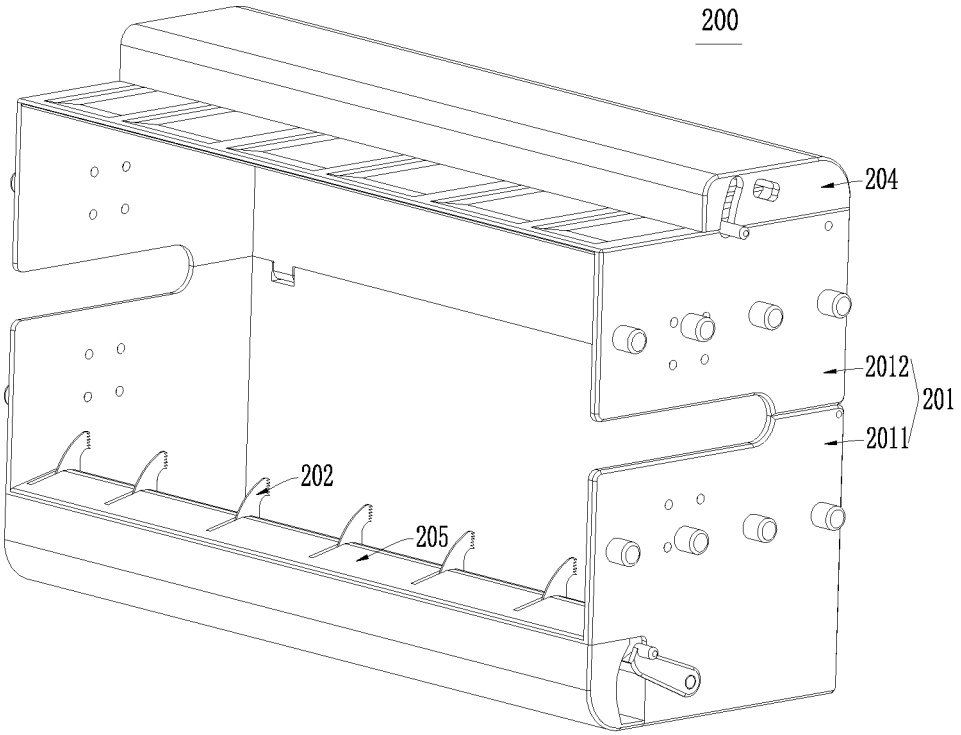
FIG. 12 is a schematic three-dimensional structural view of the cleaning medium collection device of an embodiment of the disclosure with paper detaching hooks being in an outstretched state.
Figure 13:
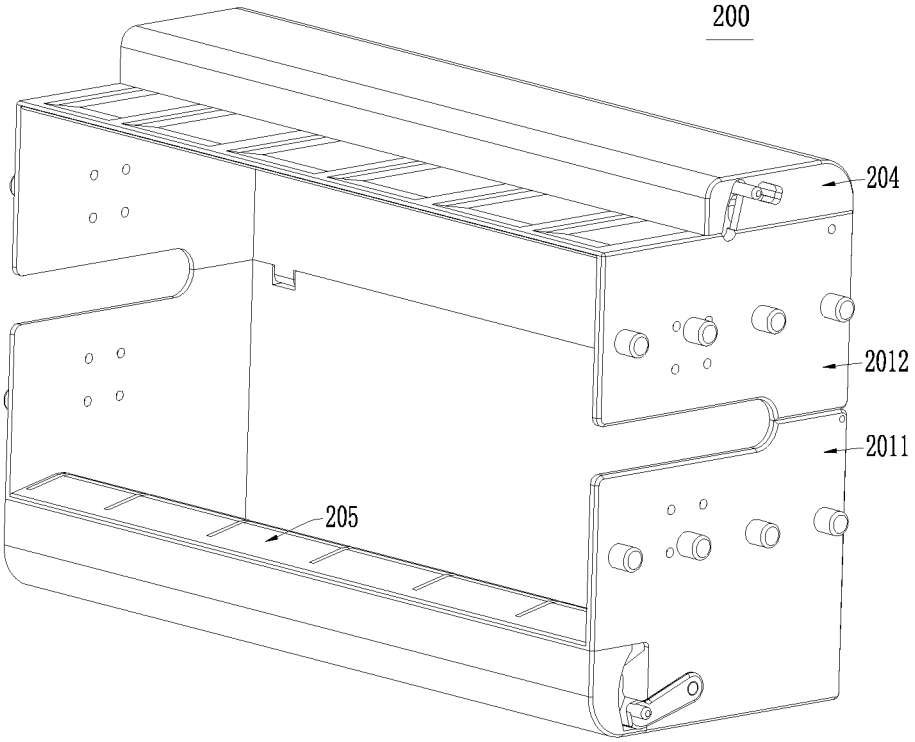
FIG. 13 is a schematic three-dimensional structural view of the cleaning medium collection device of an embodiment of the disclosure with the paper detaching hooks being in a hidden state.
Figure 14:
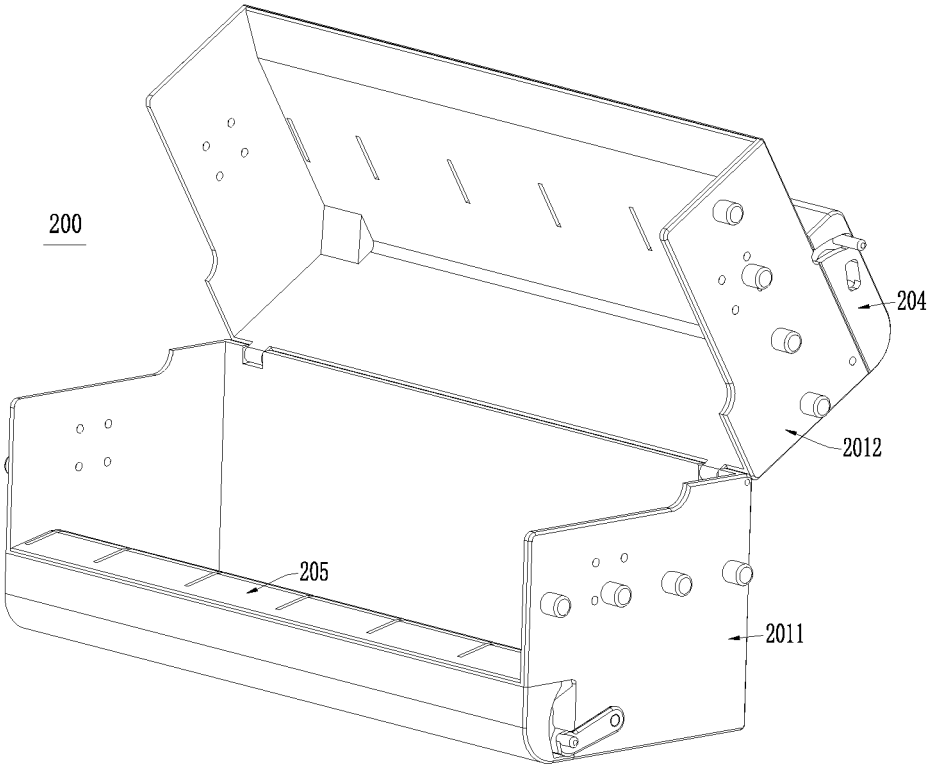
FIG. 14 is a schematic three-dimensional structural view of the cleaning medium collection device of an embodiment of the disclosure in an open state.
Figure 15:
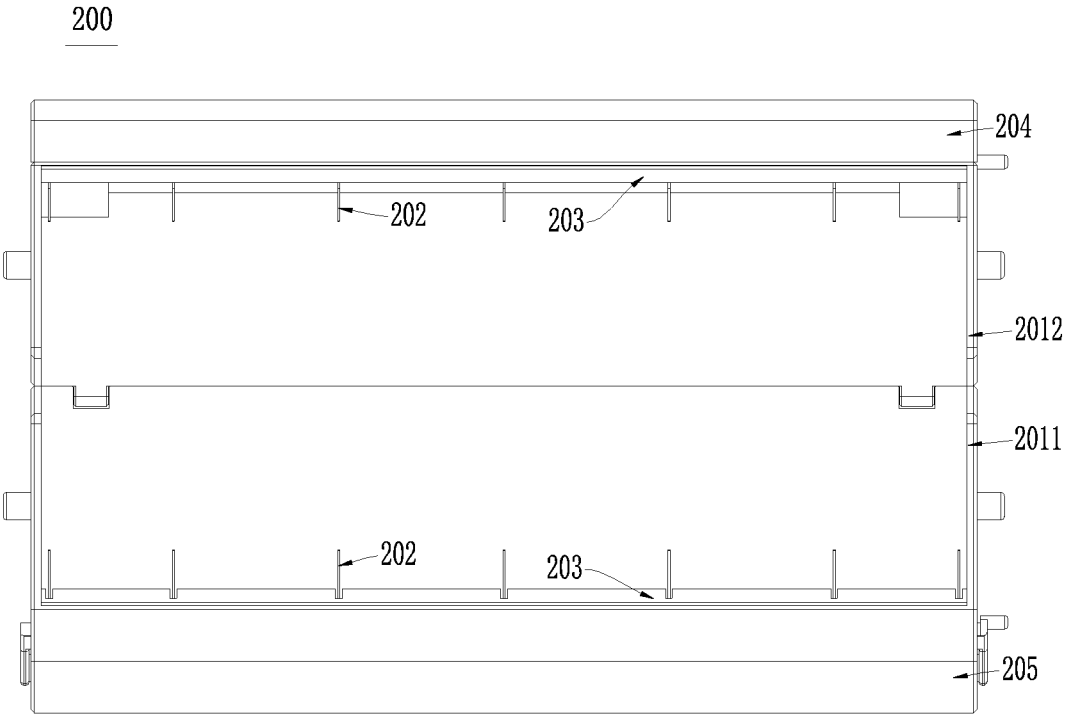
FIG. 15 is a front view of the cleaning medium collection device of an embodiment of the disclosure.

Further, in order to avoid a potential safety hazard caused by non-simultaneous exposure of the saw teeth arranged on the paper detaching hooks 202, the paper detaching hooks 202 have an outstretched state and a hidden state. Specifically, the collection box 201 is provided with cover bodies, including an upper cover body 204 and a lower cover body 205 respectively arranged on the upper housing 2012 and the lower housing 2011. As shown in FIG. 12, when being in the outstretched state, the paper detaching hooks 202 extend into the housing, so that the dirty cleaning medium that has been loosened on the cleaning module 100 may be hooked and demounted. As shown in FIG. 13, when being in the hidden state, the paper detaching hooks 202 are received in the cover bodies. Specifically, the upper paper detaching hooks are received in the upper cover body 204, and the lower paper detaching hooks are received in the lower cover body 205. The rotating shafts 203 drive the paper detaching hooks 202 to be switched between the received state and the outstretched state. The rotating shafts 203 may be driven by a motor to rotate.

After the dirty cleaning medium is demounted, a clean cleaning medium needs to be mounted on the cleaning module 100. As shown in FIG. 20A to FIG. 20F, a cleaning medium mounting device 300 of an embodiment of the disclosure includes a chassis 301, a floating plate 302 connected with the chassis 301 and movable relative to the chassis 301, and a supply module 303. Ends of the floating plate 302 are rotatably connected with gripping jaws 304. The supply module 303 includes a reel (fixable to the housing of the base station) and a cleaning medium wound around the reel. The clean cleaning medium provided by the supply module 303 corresponds to the floating plate 302. When the cleaning module 100 forces the floating plate 302 to move close to the chassis 301 until the gripping jaws 304 push against the chassis 301, the gripping jaws 304 rotate inwards, thereby driving the turnover piece 102 to be switched from the open state to the closed state.

In this embodiment, the floating plate 302 may move horizontally relative to the chassis 301. An elastic piece 305 is arranged between the chassis 301 and the floating plate 302. Specifically, the elastic piece 305 may be a plurality of springs that apply an elastic force directed away from the chassis 301 to the floating plate 302. In order to stop outward movement of the floating plate 302, i.e. movement away from the chassis 301, the chassis 301 is provided with stop portions 306. The stop portions 306 stop movement of the floating plate 302 away from the chassis 301.

The stop portions 306 are arranged at upper and lower ends of the chassis 301 and extend to the floating plate 302. There is a limit position for rotation of the gripping jaw 304 relative to the floating plate 302, and this limit position of the gripping jaw 304 may be defined by an arresting portion arranged on a back face of the floating plate 302. When the floating plate 302 moves away from the chassis 301 until the gripping jaw 304 comes into contact with the stop portion 306, the gripping jaw 304 starts to rotate towards the arresting portion. After the gripping jaw 304 pushes against the arresting portion, the gripping jaw 304 arrives at the limit position and cannot rotate any more, and the floating plate 302 is stopped accordingly.

Further, a surface of the chassis 301 pointing to the floating plate 302 is provided with protrusions 307 corresponding to the gripping jaws 304, and ends of the protrusions 307 are smooth. As shown in FIG. 20E, the gripping jaw 304 is bent and is substantially shaped like a FIG. 7, including a pivoting section 3041 rotatably connected with the floating plate 302 and a pressing section 3042 connected with the pivoting section 3041. The pivoting section 3041 and the pressing section 3042 are preferably integrally constructed, and the back of a joint of both is also smooth. When the cleaning module 100 forces the floating plate 302 to move close to the chassis 301 until the gripping jaws 304 push against the protrusions 307, the backs of the gripping jaws 304 roll on the protrusions 307, so that the gripping jaws 304 turn inwards to drive the pressing section 3042 to rotate inwards, thereby forcing the turnover piece 102 to move to the closed state.

Since the clean cleaning medium released by the supply module 303 is wound around the reel in advance, the released clean cleaning medium will be correspondingly bent rather than leveled when it sags to a position corresponding to the floating plate 302 under the action of gravity. In order to facilitate normal mounting of the cleaning medium on the cleaning module 100, the cleaning medium needs to be maintained in a relatively leveled state. Therefore, the cleaning medium mounting device 300 further includes a leveling piece configured to level the cleaning medium released by the supply module 303.

The leveling piece may level the cleaning medium through air flow, a pressure bar, etc. For example, in a specific embodiment, the leveling piece is a rod body 308 that is rotatably arranged on the housing of the base station and driven by the motor. The rod body 308 rotates to level the cleaning medium. Alternatively, in other embodiments, the leveling piece may be a fan or a blower that blows air to level the cleaning medium.

In order to transport the clean cleaning medium released by the supply module 303 to the position corresponding to the floating plate 302, a pushing mechanism 309 is further arranged between the supply module 303 and the floating plate 302 to transport the cleaning module 100 released by the supply module 303 to the floating plate 302. As shown in FIG. 20A to FIG. 20F, the pushing mechanism 309 includes two pushing wheels arranged opposite to each other, namely a first pushing wheel 3091 and a second pushing wheel 3092. The first pushing wheel 3091 and the second pushing wheel 3092 rotate in opposite directions. In this way, when the first pushing wheel 3091 and the second pushing wheel 3092 rotate, the cleaning medium is compressed between the two pushing wheels 3091, 3092 and is dragged downwards under the action of a frictional force, thereby realizing transport of the cleaning medium.

Further, the pushing mechanism 309 further includes a driving assembly 310 connected with the first pushing wheel 3091 and configured to drive the first pushing wheel 3091 to move close to or away from the second pushing wheel 3092. The driving assembly 310 drives the first pushing wheel 3091 to move relative to the second pushing wheel 3092, so that the distance between the two pushing wheels 3091, 3092 is adjustable, thereby realizing pushing, compression and release of the cleaning medium. Thus, needs of different steps for cleaning medium mounting are met.

In some embodiments, the driving assembly 310 may be a telescopic member, such as a pneumatic cylinder, a hydraulic cylinder, a telescopic joint, etc. The first pushing wheel 3091 is arranged at an end of the telescopic member. In other embodiments, the driving assembly 310 may adopt a structure in which a cam 3101 cooperates with a link rod. Specifically, as shown in FIG. 20A to FIG. 20F, the driving assembly 310 includes the cam 3101 and a pendulum bar 3102 that are rotatably arranged on the housing of the base station, a sliding piece 3103 slidably arranged on the housing of the base station, and a pressure spring 3104 arranged between a first end of the sliding piece 3103 and the housing of the base station. The first pushing wheel 3091 is arranged at a second end of the sliding piece 3103. Lower ends of the cam 3101 and the pendulum bar 3102 are in contact with each other. An upper end of the pendulum bar 3102 pushes against the sliding piece 3103. A rotatable connection point for the pendulum bar 3102 and the housing of the base station is located between the upper and lower ends. The pressure spring 3104 applies to the sliding piece 3103 an elastic force for compressing the first pushing wheel 3091 and the second pushing wheel 3092.

Figure 20F:
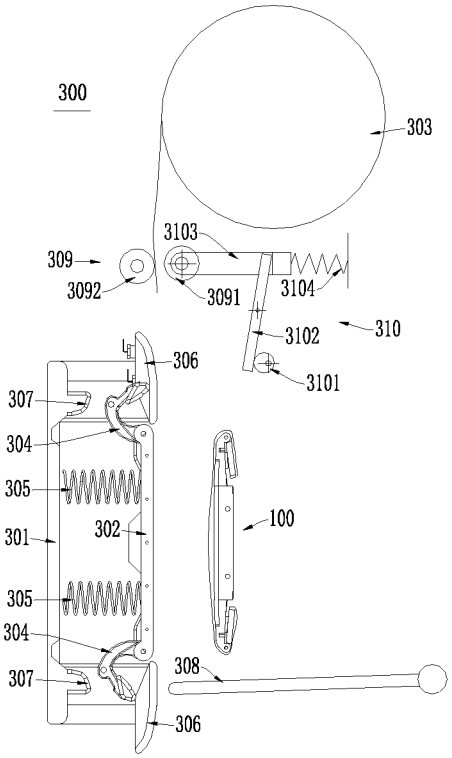

As shown in FIG. 20A to FIG. 20E, when a point of the cam 3101 having the minimum potential energy comes in contact with the lower end of the pendulum bar 3102, the pendulum bar 3102 is substantially in a vertical state, and the first pushing wheel 3091 and the second pushing wheel 3092 are compressed by the elastic force of the pressure spring 3104. As shown in FIG. 20F, when a point of the cam 3101 having the maximum potential energy comes in contact with the lower end of the pendulum bar 3102, the pendulum bar 3102 is driven to rotate, and its upper end moves away from the second pushing wheel 3092, so that the sliding piece 3103 is driven to move away from the second pushing wheel 3092. Thus, a clearance is formed between the first pushing wheel 3091 and the second pushing wheel 3092, thereby canceling compression performed on the cleaning medium.

A process in which the cleaning medium mounting device 300 mounts the cleaning medium for the cleaning module 100 will be described below with respect to FIG. 20A to FIG. 20F.

As shown in FIG. 20A, the first pushing wheel 3091 compresses the second pushing wheel 3092, the two pushing wheels 3091, 3092 rotate in opposite directions, the cleaning medium is dragged downwards under the action of a frictional force, and the cleaning medium sags under the action of gravity.

As shown in FIG. 20B, the leveling piece rotates to level a crimped cleaning medium.

As shown in FIG. 20C, the cleaning module 100 moves forwards to press the floating plate 302.

As shown in FIG. 20D, the cleaning module 100 continues to move forwards, and the cleaning medium is pulled apart because the two pushing wheels 3091, 3092 compress the cleaning medium.

As shown in FIG. 20E, the cleaning module 100 continues to move forwards, and the gripping jaws 304 turn to compress the cleaning medium on the adhesion face 1021 of the turnover piece 102.

As shown in FIG. 20F, the cleaning module 100 moves backwards. Meanwhile, the leveling piece is lifted, and the first pushing wheel 3091 is separated from the second pushing wheel 3092.

FIG. 21A to FIG. 21L are procedure views showing that the base station 500 including the above cleaning medium collection device 200 and cleaning medium mounting device 300 replaces the cleaning medium for the cleaning robot 600. It can be seen from the above description that, in order to realize replacement of the cleaning medium, a dirty cleaning medium originally carried by the cleaning module 100 needs to be demounted by the cleaning medium collection device 200 before a clean cleaning medium is mounted on the cleaning module 100 by the cleaning medium mounting device 300. Therefore, in order to demount and mount the cleaning medium on the base station, the base station should be further provided with a mechanism for connecting the cleaning medium collection device 200 and the cleaning medium mounting device 300, which will be specifically described as follows:

As shown in FIG. 21A to FIG. 21L, the housing 502 of the base station 500 is provided with an entrance/exit (not shown) for the cleaning robot 600. A base plate tray 503 for carrying the cleaning module 100 is arranged inside the housing 502. The base plate tray 503 is arranged on a lifting mechanism 501 and is driven by the lifting mechanism 501 to move upwards and downwards. In this embodiment, the lifting mechanism 501 may include a belt-like structure vertically arranged in the housing 502, such as a synchronous belt, a transmission belt or the like. Two synchronous wheels are arranged in the housing 502, one close to the upper end, and the other close to the bottom. The synchronous belt or the transmission belt is wound around the two synchronous wheels. The base plate tray 503 is fixed to a vertical section at either side of the synchronous belt or the transmission belt.

Figure 21A:
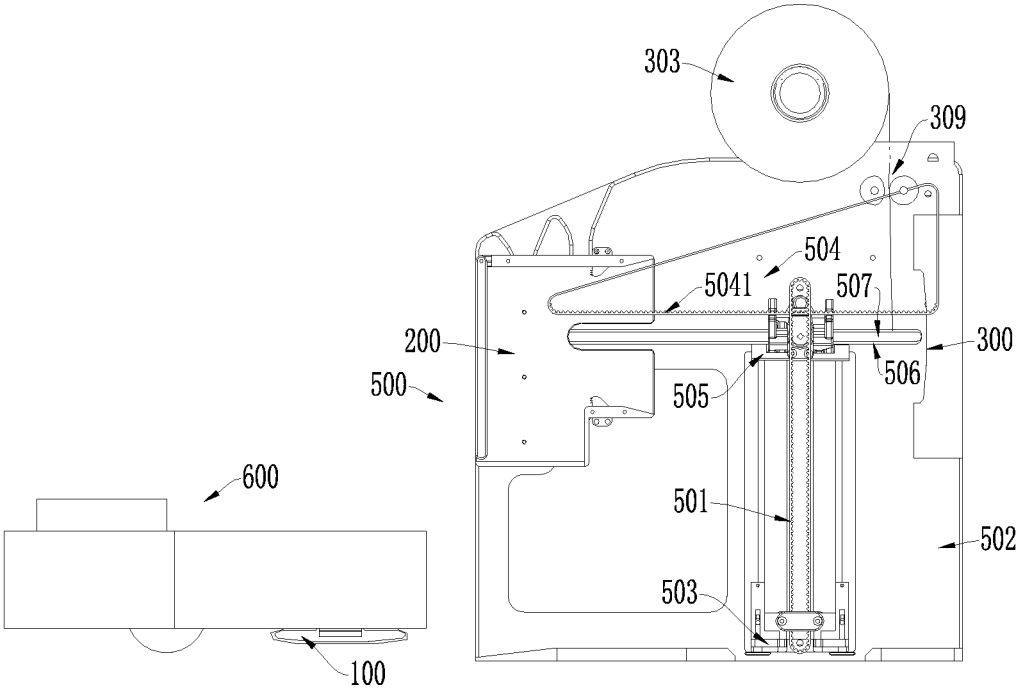
FIG. 21A to FIG. 21L are procedure views showing that a base station of an embodiment of the disclosure replaces the cleaning medium for the cleaning robot.

As shown in FIG. 21A, a moving mechanism 504 is arranged on the housing 502, close to the upper end. The moving mechanism 504 may also include a belt-like structure, such as a synchronous belt, a transmission belt or the like. The belt-like structure is wound around a plurality of belt wheels, and at least a horizontal traction section 5041 is formed. As shown in FIG. 21E, the horizontal traction section 5041 of the moving mechanism 504 is fixedly connected with an adsorption plate 505 through a connection assembly, and the adsorption plate 505 is rotatably connected with the connection assembly. Specifically, a first chute 506 and a second chute 507 that are horizontal are arranged on an inner wall of the housing 502, close to the upper end. The size of the first chute 506 is smaller than that of the second chute 507, and the two chutes are arranged at a same horizontal position. The inner wall of the housing 502 is further provided with a third chute 508. The third chute 508 is shaped like a peak and communicates with the second chute 507 through smooth transition. The third chute 508 corresponds to the position of the lifting mechanism 501.

The connection assembly includes a first roller wheel 509 arranged in the first chute 506 and capable of moving horizontally in the first chute 506, and a first connector 510 and a second connector 511 that are rotatably connected with the first roller wheel 509. The first connector 510 is fixedly connected with the horizontal traction section 5041 of the moving mechanism 504. One end of the second connector 511 is connected with the adsorption plate 505, and the other end is rotatably provided with a second roller wheel 512. The second roller wheel 512 may slide in the second chute 507 and the third chute 508. The first connector 510, the second connector 511 and the first roller wheel 509 may be rotatably connected in the following mode: the second connector 511 is shaped like a sheet or a plate, one side of the second connector pointing to the first chute 506 is provided with a rotating shaft, and the first roller wheel 509 is rotatably arranged on the rotating shaft. The end of the rotating shaft may extend to one side of the first roller wheel 509 opposite to the first chute 506. The first connector 510 is also shaped like a sheet or a plate, and is fixedly connected with the end of the rotating shaft.

Alternatively, a round hole adapted to the first roller wheel 509 in shape and size is arranged in the second connector 511. One part of the first roller wheel 509 is embedded in the round hole and can rotate therein, and the other part is located outside the round hole. The part exposed outside the round hole is embedded in the first chute 506. A circle center position of the first roller wheel 509 may be provided with the rotating shaft that extends away from the first chute 506. The first connector 510 may be provided with a shaft hole, and the rotating shaft passes through the shaft hole.

The adsorption plate 505 has a horizontal position and a vertical position. Specifically, when the lifting mechanism 501 transports the cleaning module 100 upwards to the vicinity of the adsorption plate 505, the cleaning module 100 is adsorbed at the lower end of the adsorption plate 505 under the action of a magnetic force. At this point, the second roller wheel 512 is located in the third chute 508, and the whole adsorption plate 505 is in a horizontal position state. When the moving mechanism 504 moves, the adsorption plate 505 connected with the horizontal traction section 5041 of the moving mechanism 504 through the connection assembly turns.

Specifically, when the horizontal traction section 5041 moves leftwards, the second roller wheel 512 that is originally in the vertical state in the third chute 508 will enter the left half of the horizontal second chute 507. Thus, under the stop action of the second roller wheel 512 and the second chute 507, the adsorption plate 505 rotates clockwise upwards, which is a process as illustrated in FIG. 21D to FIG. 21E. Correspondingly, when the horizontal traction section 5041 moves leftwards, the second roller wheel 512 that is originally in the vertical state in the third chute 508 will enter the right half of the horizontal second chute 507, and the adsorption plate 505 rotates counterclockwise upwards. This is a process as illustrated in FIG. 21G to FIG. 21H.

In this embodiment, the collection box 206 of the cleaning medium collection device 200 is located at one end (the left side as illustrated in FIG. 21A to FIG. 21L) of the horizontal traction section 5041, and the cleaning medium mounting device 300 is arranged at the outer side of the other end of the horizontal traction section 5041.

A complete process in which the base station 500 of an embodiment of the disclosure replaces the cleaning medium for the cleaning module 100 will be described below with respect to FIG. 21A to FIG. 21L.

As shown in FIG. 21A, the cleaning robot 600 is ready to enter the base station 500 to replace the cleaning medium. At this point, the base plate tray 503 is located at the bottom of the housing 502, the second roller wheel 512 is located in the third chute 508, and the adsorption plate 505 is in the horizontal position state.

Figure 21B:
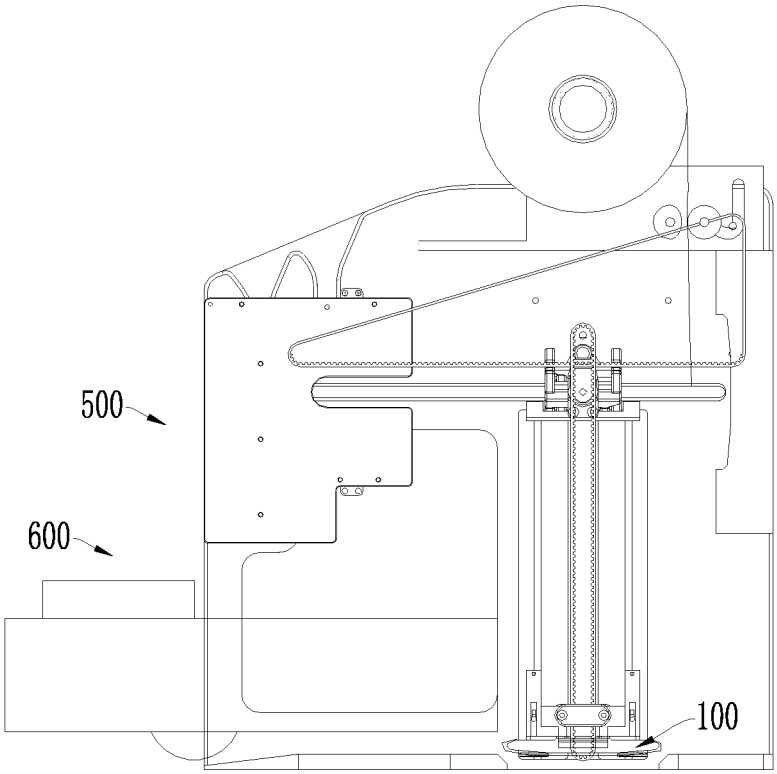

As shown in FIG. 21B, the cleaning robot 600 enters the base station 500 via the entrance/exit, unloads the cleaning module 100 onto the base plate tray 503 and moves backwards a certain distance.

Figure 21C:
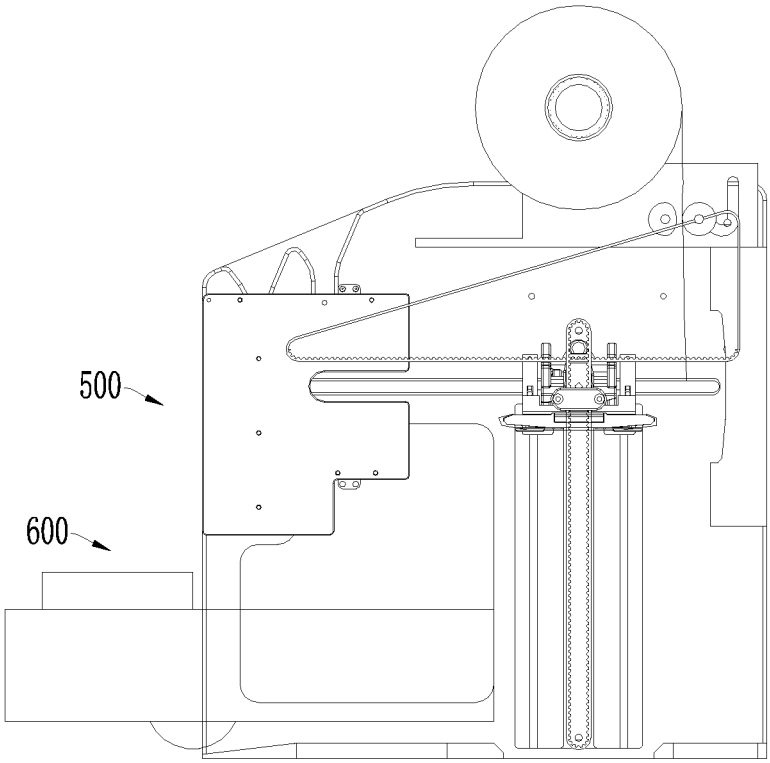
Figure 21D:
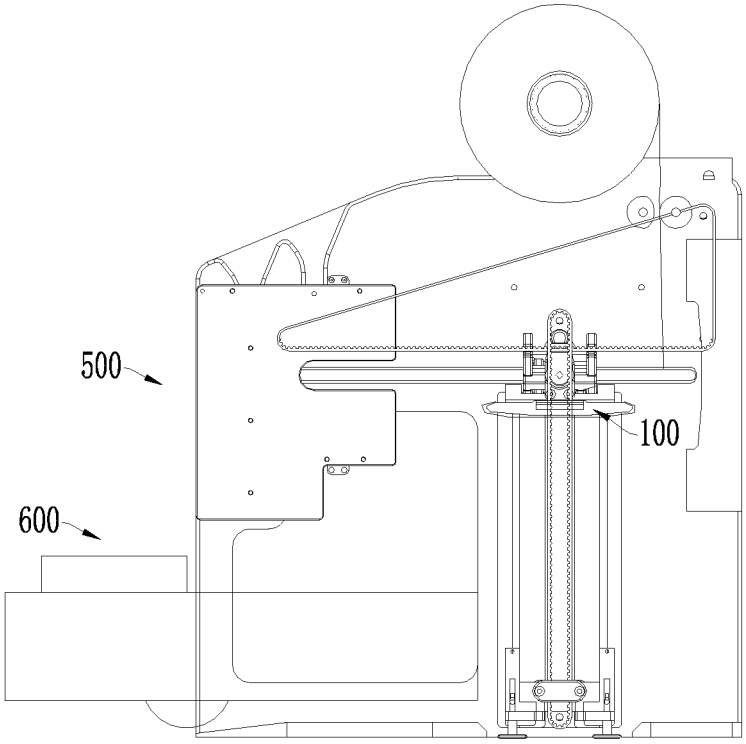
Figure 21E:
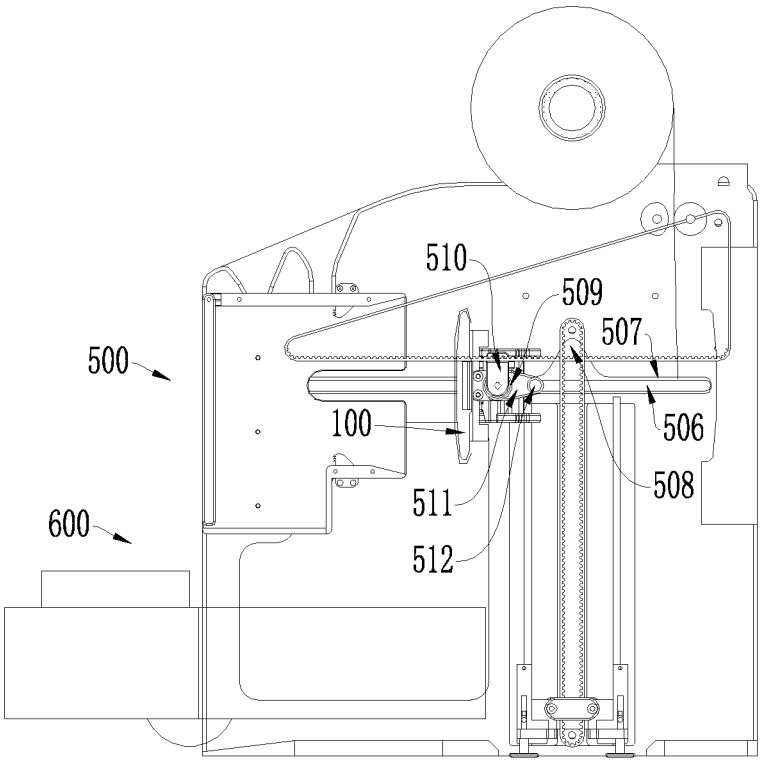

As shown in FIG. 21C, the lifting mechanism 501 drives the base plate tray 503 to move upwards, so as to transport the cleaning module 100 carried thereby to the adsorption plate 505.

As shown in FIG. 21D, under the action of the magnetic force, the cleaning module 100 is adsorbed by the adsorption plate 505. The lifting mechanism 501 descends, and the base plate tray 503 returns to the bottom of the base station 500.

As shown in FIG. 21E, the moving mechanism 504 rotates clockwise, and the horizontal traction section 5041 moves leftwards. The second roller wheel 512 enters the left half of the second chute 507 from the third chute 508, and the adsorption plate 505 rotates leftwards by 90 degrees and is switched to the vertical position state. Subsequently, the moving mechanism 504 continues to operate, and the adsorption plate 505 along with the fixed cleaning module 100 continues to move towards the collection box 206.

Figure 21F:
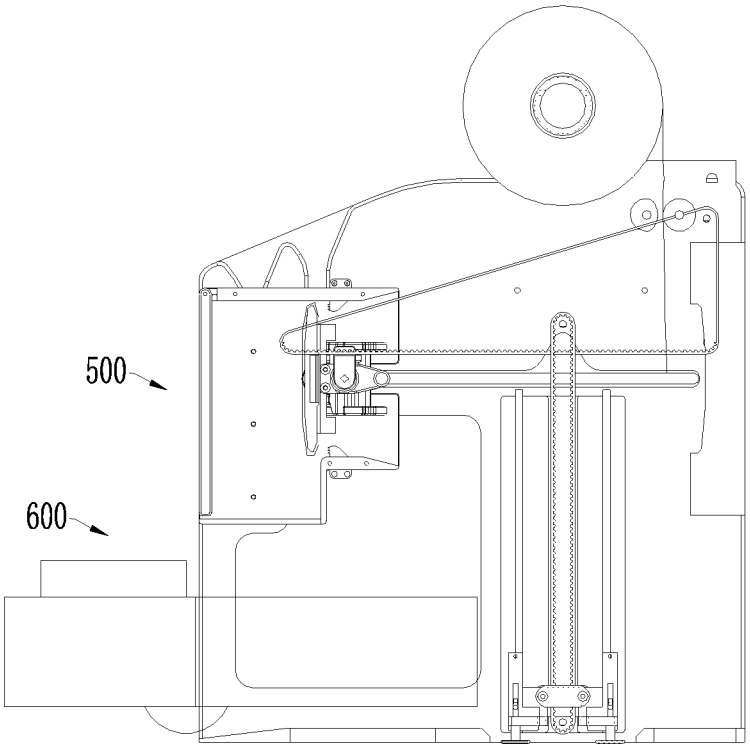
Figure 21G:
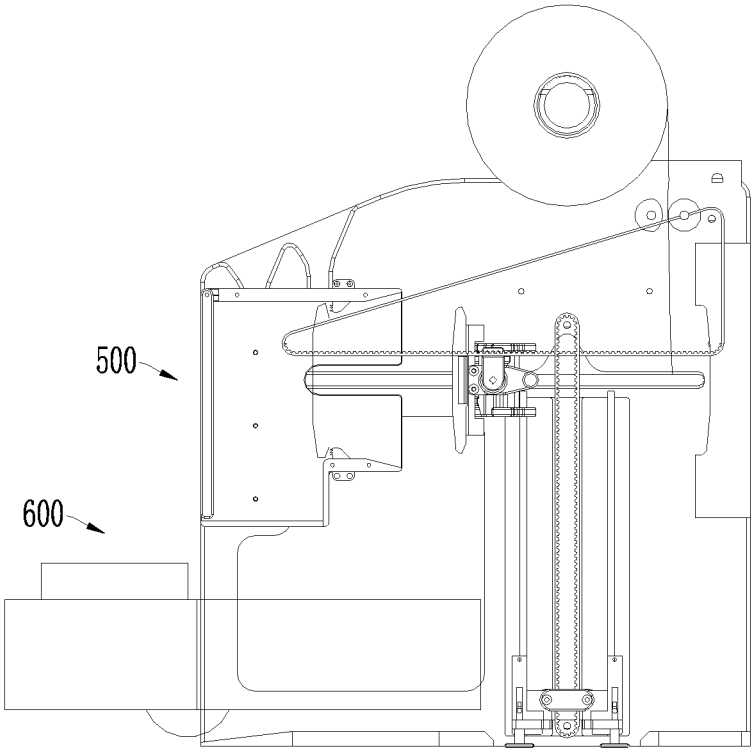
Figure 21H:
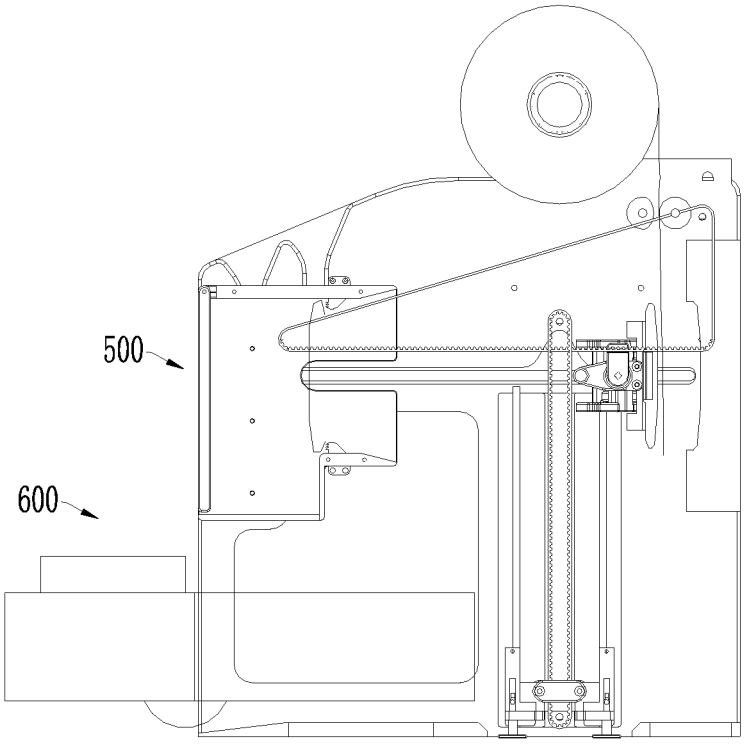

As shown in FIG. 21F, the adsorption plate 505 and the cleaning module 100 enter the collection box 206 via the opening.

As shown in FIG. 21G, the moving mechanism 504 rotates counterclockwise reversely, so as to drive the adsorption plate 505 and the cleaning module 100 to move backwards. When the cleaning module 100 travels through the paper detaching hooks 422, the dirty cleaning medium mounted thereon is hooked and retained and then falls into the collection box 206.

Figure 21I:
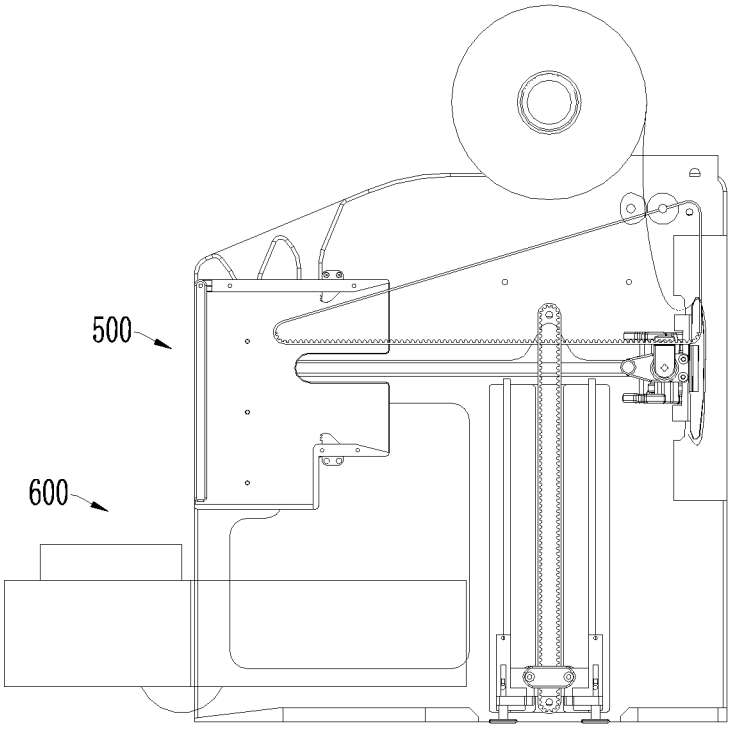

As shown in FIG. 21H to 21I, the moving mechanism 504 continues to rotate reversely, and the adsorption plate 505 and the cleaning module 100 continue to move backwards (rightwards). This is a process in which the cleaning medium mounting device 300 mounts the clean cleaning medium for the cleaning module 100. The process has been described above and will not be repeated here.

Figure 21J:
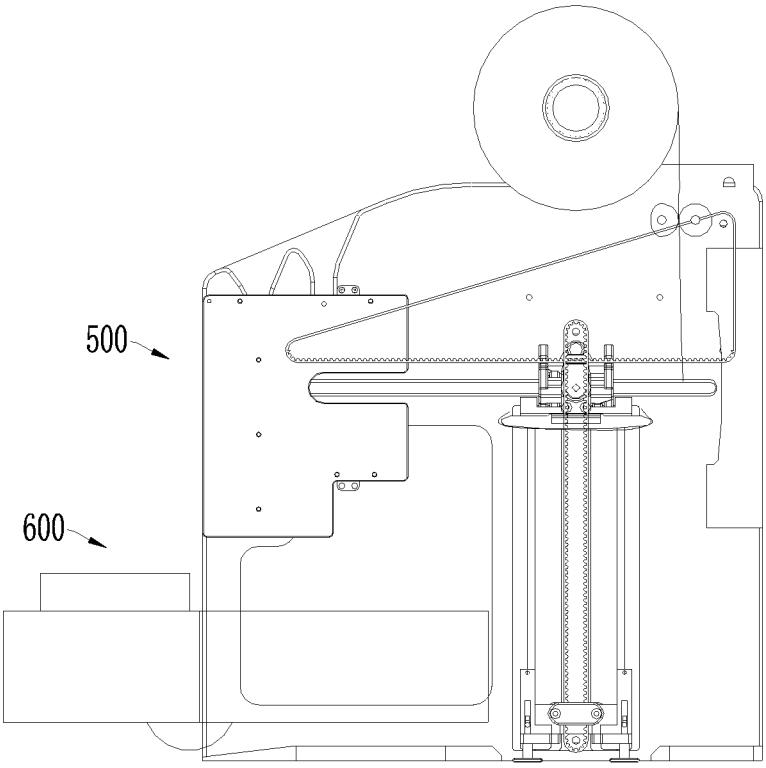

As shown in FIG. 21J, the moving mechanism 504 reversely drives the adsorption plate 505 and the cleaning module 100 to move leftwards until the second roller wheel 512 enters the third chute 508 again via the second chute 507 and stops, and the adsorption plate 505 together with the cleaning module 100 returns to the horizontal position state.

Figure 21K:
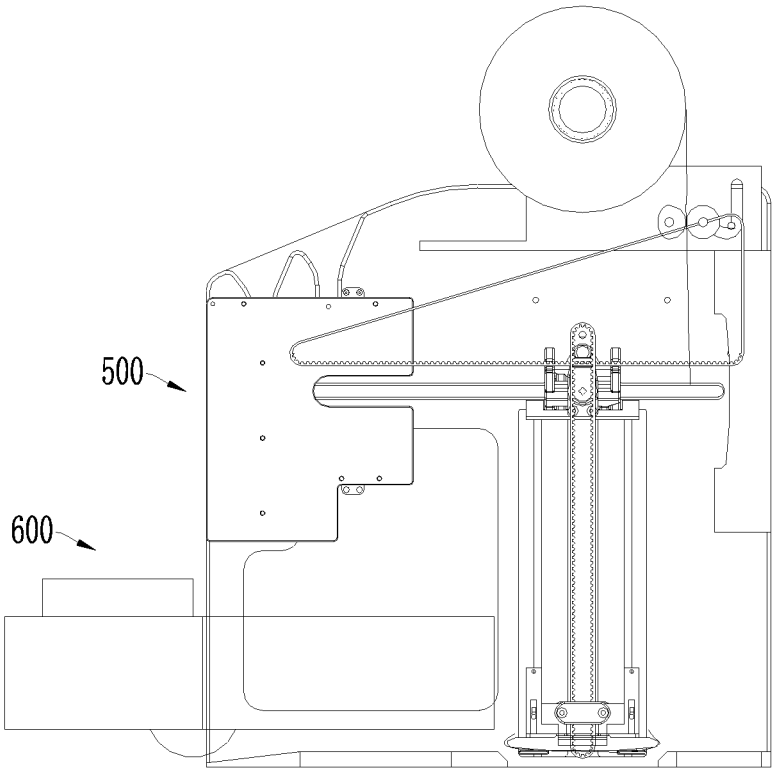

As shown in FIG. 21K, the lifting mechanism 501 drives the base plate tray 503 to ascend, so as to remove the cleaning module 100 from the adsorption plate 505. Subsequently, the base plate tray 503 carrying the cleaning module 100 is driven to descend to the bottom.

Figure 21L:
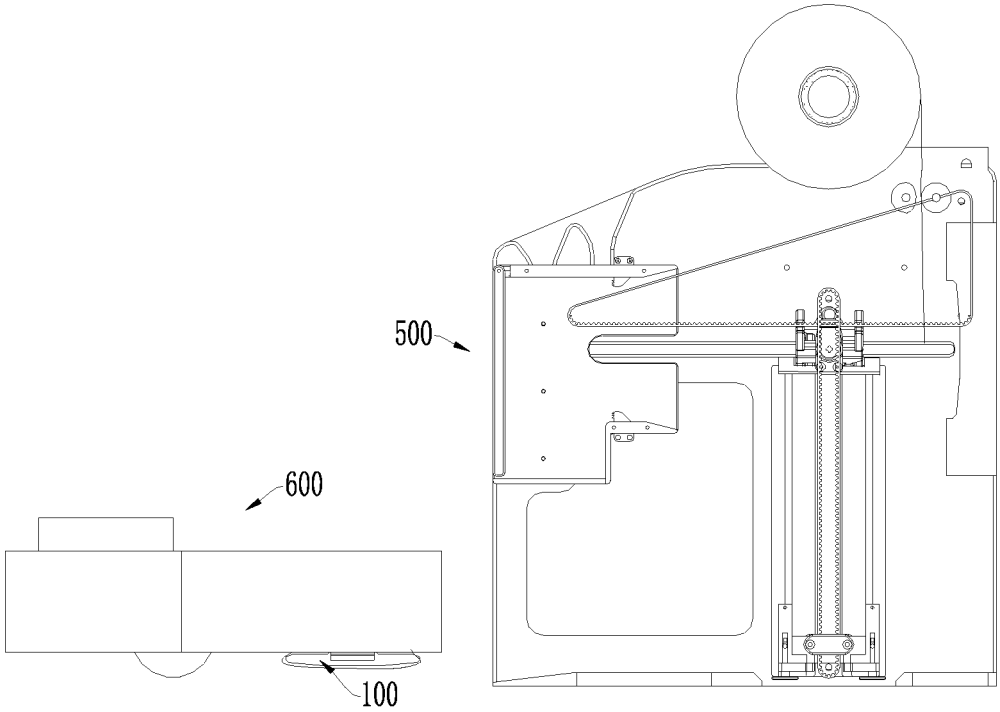

As shown in FIG. 21L, the cleaning robot 600 travels into the base station 500 to have the cleaning module 100 mounted, and then exits the base station 500 to start working.

In this embodiment, the adsorption plate 505 and the cleaning module 100 may realize detachable magnetism in the following mode: the adsorption plate 505 is provided with an electromagnet, and the electromagnet is electrified to produce a magnetic field when the cleaning module 100 needs to be adsorbed on the adsorption plate 505. When the cleaning module 100 needs to be removed from the adsorption plate 505 (the step as shown in FIG. 21K), the electromagnet is de-electrified, and the magnetic field disappears, so that the cleaning module 100 falls onto the base plate tray 503 under the action of gravity.

It should be noted that, in the description of the disclosure, the terms "first", "second", etc. are merely used for descriptive purposes and used to distinguish between similar objects. There is no priority for them, and they should not be understood as indicating or implying relative importance. In addition, in the description of the disclosure, unless otherwise stated, the term "a plurality of" means two or more.

Mentioned above are only several embodiments of the disclosure, and those skilled in the art can make various modifications or variations to the embodiments of the disclosure according to the contents disclosed in the application documents without departing from the spirit and scope of the disclosure.

What is claimed is:

1. A cleaning robot system, comprising:

a cleaning robot:

a cleaning module, connected to the cleaning robot and configured to clean a working surface, and a base station for accommodating the cleaning robot, wherein the cleaning robot comprises:

a framework;

a moving module, arranged at a bottom of the framework to drive the cleaning robot to travel on a working surface;

wherein the cleaning module comprises:

a main body, connectable with a cleaning medium to wipe the working surface, wherein the main body includes:

a connection region comprising an adhesion surface for connection of the cleaning medium to the adhesion surface; and a demounting region for demounting of the cleaning medium, and wherein no interconnection action occurs between the demounting region and the cleaning medium; and wherein the base station comprises:

a housing; and a separation module comprising:

saw teeth configured to hook the cleaning medium; and detaching hooks provided with the saw teeth, the detaching hooks corresponding to the demounting region to hook the cleaning medium covering the demounting region so as to separate the cleaning medium from the main body.

2. The cleaning robot system according to claim 1, wherein one face of the detaching hook is arranged as a smooth face for the cleaning module and the cleaning medium to move beyond; and wherein another face opposite to the smooth face is provided with the saw teeth for hooking the cleaning medium.

3. The cleaning robot system according to claim 1, wherein the demounting region comprises notches, the notches being adapted to the saw teeth to enable the saw teeth to demount the cleaning medium from the notches.

4. The cleaning robot system according to claim 3, wherein an outer edge of the main body is recessed into the main body to form the notches.

5. The cleaning robot system according to claim 4, wherein the base station further comprises: a moving mechanism for driving the cleaning module to move, the moving mechanism being configured to drive the cleaning module to move beyond the detaching hooks through the notches and then drive the cleaning module to reverse movement, so that the cleaning medium covering the demounting region is hooked by the detaching hooks, and the cleaning medium is demounted.

6. The cleaning robot system according to claim 1, wherein the main body has an integral body, a bottom face of the integral body pointing to the working surface, the cleaning medium being connected to the integral body, and the connection region and the demounting region being arranged on the integral body.

7. The cleaning robot system according to claim 1, wherein the connection region and/or the demounting region are/is arranged in at least a pair of two opposite ends of the main body.

8. The cleaning robot system according to claim 7, wherein the main body at least comprises a pair of opposite long ends, wherein the connection region and/or the demounting region being at least partially arranged on the opposite long ends, wherein the opposite long ends each comprising two head portions, and the head portions being provided with the connection region.

9. The cleaning robot system according to claim 7, wherein a number of the demounting regions arranged at each of the two ends is at least two.

10. The cleaning robot system according to claim 7, wherein a number of the connection regions arranged at each of the two ends is at least two, and every two adjacent ones of the connection regions are mutually non-contiguous.

11. The cleaning robot system according to claim 1, wherein a number of the demounting regions arranged on the main body is at least two, wherein the connection region arranged at one end of the main body is a whole, wherein projections of the at least two demounting regions to a lateral direction of the main body form first projections, wherein a projection of the connection region to the lateral direction of the main body forms a second projection, and wherein the first projections and the second projection at least partially overlap.

12. The cleaning robot system according to claim 1, wherein the base station further comprises: a collection box, configured to collect the cleaning medium separated by the separation module, wherein the collection box is arranged on a moving path of the separated cleaning medium, thereby making the cleaning medium enter the collection box.

13. The cleaning robot system according to claim 12, wherein the collection box is arranged on the moving path such that the separated cleaning medium falls by its own gravity, thereby making the separated cleaning medium fall into the collection box.

14. The cleaning robot system according to claim 13, wherein an upper side of the collection box is provided with an opening, and the collection box is arranged below the cleaning medium during separation.

15. The robot cleaning system according to claim 13, wherein an upper side of the collection box is provided with an opening, and the separation module is arranged above the opening relative to the collection box.

16. The cleaning robot system according to claim 12, wherein the collection box is arranged on the moving path of the separated cleaning medium such that it receives an external force applied by the separation module, thereby making the cleaning medium enter the collection box.

17. The cleaning robot system according to claim 1, wherein the detaching hooks are configured to hook the cleaning medium on the main body and apply an external force directed away from the main body to the cleaning medium to separate the cleaning medium from the main body.

* * * * *